US009532693B1

(12) United States Patent
Tran et al.

(10) Patent No.: US 9,532,693 B1
(45) Date of Patent: Jan. 3, 2017

(54) UNATTENDED SPOT CLEANING WITH SURFACE SANITIZATION

(71) Applicant: BISSELL Homecare, Inc., Grand Rapids, MI (US)

(72) Inventors: Phong Hoang Tran, Grand Rapids, MI (US); Charles A. Reed, Jr., Rockford, MI (US); Jeremy Moog, Lowell, MI (US); Eric C. Huffman, Lowell, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 516 days.

(21) Appl. No.: 14/027,691

(22) Filed: Sep. 16, 2013

Related U.S. Application Data

(62) Division of application No. 12/473,847, filed on May 28, 2009, now Pat. No. 8,549,697.

(60) Provisional application No. 61/057,035, filed on May 29, 2008.

(51) Int. Cl.
*A47L 11/40* (2006.01)

(52) U.S. Cl.
CPC ..... *A47L 11/405* (2013.01); *A47L 11/4044* (2013.01); *A47L 11/4088* (2013.01)

(58) Field of Classification Search
CPC .. A47L 11/34; A47L 11/4088; A47L 11/4083; A47L 11/4044; A47L 11/30; A47L 11/405
See application file for complete search history.

(56) References Cited

U.S. PATENT DOCUMENTS

| | | | | |
|---|---|---|---|---|
| 2,590,152 | A * | 3/1952 | McGowan | A47L 7/04 134/1 |
| 3,699,607 | A | 10/1972 | Putt | |
| 4,046,989 | A | 9/1977 | Parise et al. | |
| 4,114,229 | A | 9/1978 | Jones et al. | |
| 5,236,512 | A * | 8/1993 | Rogers | A47L 11/00 134/1 |
| 5,502,872 | A | 4/1996 | Chae et al. | |
| 5,613,509 | A * | 3/1997 | Kolb | B24C 1/003 134/1 |
| 5,987,696 | A | 11/1999 | Wang | |
| 6,131,237 | A | 10/2000 | Kasper et al. | |
| 7,073,226 | B1 | 7/2006 | Lenkiewicz et al. | |
| 7,228,589 | B2 * | 6/2007 | Miner | A47L 11/34 15/320 |
| 8,051,527 | B2 | 11/2011 | Lee | |
| 2005/0022333 | A1 | 2/2005 | McDowell et al. | |
| 2006/0272120 | A1 | 12/2006 | Barrick et al. | |
| 2007/0209143 | A1 * | 9/2007 | Choi | A47L 9/2805 15/339 |

(Continued)

FOREIGN PATENT DOCUMENTS

DE 19522893 A1 2/1996

*Primary Examiner* — Robert Scruggs
(74) *Attorney, Agent, or Firm* — McGarry Bair PC

(57) ABSTRACT

An unattended extraction cleaning machine includes a housing with a bottom portion that is adapted to rest on a surface to be cleaned, a fluid delivery system including a fluid distributor, a fluid extraction system including a suction nozzle, at least one carriage assembly mounting the suction nozzle to the housing for movement with respect thereto and with respect to the surface to be cleaned, and an ultraviolet light mounted on at least one of the housing and the carriage assembly to emit ultraviolet light onto the surface to be cleaned.

13 Claims, 19 Drawing Sheets

(56) References Cited

U.S. PATENT DOCUMENTS

| | | | | |
|---|---|---|---|---|
| 2007/0283986 | A1* | 12/2007 | Baum | A01M 13/003 134/201 |
| 2008/0127447 | A1 | 6/2008 | Overaag | |
| 2008/0256741 | A1* | 10/2008 | Garcia | A47L 9/00 15/319 |
| 2009/0126145 | A1 | 5/2009 | D'Agostino et al. | |

* cited by examiner

UNATTENDED SPOT CLEANING WITH SURFACE SANITIZATION

CROSS-REFERENCE TO RELATED APPLICATIONS

This application is a divisional of U.S. patent application Ser. No. 12/473,847, filed May 28, 2009, now U.S. Pat. No. 8,549,697, issued Oct. 8, 2013, which claims the benefit of U.S. Provisional Patent Application No. 61/057,035, filed May 29, 2008, both of which are incorporated herein by reference in their entireties.

BACKGROUND OF THE INVENTION

Field of the Invention

This invention relates to fluid extraction cleaning. In one of its aspects, the invention relates to an extraction cleaning machine that is adapted to clean spots in carpet and other fabric surfaces. In another of its aspects, the invention relates to a spot cleaner for carpet and other flooring surfaces that can function unattended by a user. In yet another aspect, the invention relates to an extraction cleaning machine having surface sanitization. In still another aspect, the invention relates to an extraction cleaning machine that emits ultraviolet light to sanitize a surface to be cleaned and eradicate odor causing bacteria.

Description of the Related Art

Extraction cleaning machines are known for deep cleaning carpets and other fabric surfaces such as upholstery. Most carpet extractors comprise a fluid delivery system, a fluid recovery system, and, optionally, an agitation system. The fluid delivery system typically comprises one or more fluid supply tanks for storing cleaning fluid, a fluid distributor for applying the cleaning fluid to the surface to be cleaned, and a fluid supply conduit for supplying the fluid from the supply tank to the fluid distributor. The fluid recovery system typically comprises a recovery tank, a suction nozzle adjacent to the surface to be cleaned and in fluid communication with the recovery tank through a working air conduit, and a vacuum source in fluid communication with the working air conduit to draw cleaning fluid from the surface to be cleaned through the nozzle and working air conduit into the recovery tank. The agitation system can include an agitator element for scrubbing the surface to be cleaned, an optional drive means, and selective control means. The agitation system can include a fixed or driven agitator element that can comprise a brush, pad, sponge, cloth, and the like. The agitation system can also include driving and control means including motors, turbines, belts, gears, switches, sensors, and the like. See, for example, U.S. Pat. No. 6,131,237 to Kasper et al., U.S. Pat. No. 7,073,226 to Lenkiewicz et al. Kasper et al. '237 discloses the application to a surface to be cleaned in connection with extracting fluid from the surface.

U.S. Pat. No. 7,228,589 to Miner et al. discloses a commercially available portable extraction cleaning machine known as the BISSELL SpotBot® Models 1200-A and 1200-B. The machine comprises a housing, a fluid delivery system, a fluid recovery system, an agitation system, and a controller system to automatically monitor and control inputs and outputs to said systems for removal of spots and stains from a surface without attendance by a user. A suction nozzle and agitation machine are mounted to the housing for movement over the surface to be cleaned relative to a stationary housing. Optionally, the spot cleaning apparatus can be operated in a manual mode.

U.S. Patent Application Publication No. US 2006/0272120 published on Dec. 7, 2006 discloses a portable extraction cleaning machine comprising a fluid delivery system, a fluid recovery system and ultraviolet light source positioned in or near the fluid supply tank, recovery tank, and suction nozzle to kill bacteria in the fluid used and recovered by the machine as well as the surface to be cleaned.

U.S. Pat. No. 7,228,589 to Miner et al. discloses an unattended spot cleaning apparatus having a housing bottom portion 502 that rests on the surface to be cleaned and defines an opening in the underside of the housing. A fluid delivery system includes a fluid distributor 566 that delivers cleaning fluid to the surface to be cleaned beneath the opening, and a fluid extraction system with a suction nozzle 734 recovers soiled cleaning fluid from the surface to be cleaned beneath the opening. Further, a carriage assembly 510 mounts the suction nozzle 734 to the housing for movement with respect to the housing and to the surface to be cleaned.

SUMMARY OF THE INVENTION

An unattended extraction cleaning machine according to the invention comprises a housing with a bottom portion that is adapted to rest on a surface to be cleaned and that defines an opening in an underside of the housing, a fluid delivery system mounted to the housing and including a fluid distributor for delivering a cleaning fluid to the surface to be cleaned beneath the opening in the underside the housing, a fluid extraction system including a suction nozzle for recovering soiled cleaning fluid from the surface to be cleaned beneath the opening in the underside of the housing, at least one carriage assembly mounting the suction nozzle to the housing for movement with respect thereto and with respect to the surface to be cleaned, and an ultraviolet light mounted on at least one of the housing and the carriage assembly to illuminate the surface to be cleaned.

In one embodiment, the ultraviolet light is positioned in the opening to sanitize at least a portion of the surface to be cleaned.

In another embodiment, the unattended extraction cleaning machine comprises a controller which controls the fluid delivery system and the fluid extraction system to perform a cycle of operation and further controls activation of the ultraviolet light subsequent to a cleaning of the surface to be cleaned. In one embodiment, the controller controls the ultraviolet light such that the ultraviolet light operates for a specified time subsequent to the cleaning of the surface to be cleaned.

In still another embodiment, the housing further includes a carriage assembly lens that defines the opening in the housing, and the ultraviolet light is mounted within the carriage assembly lens at or near the surface to be cleaned.

In yet another embodiment, the ultraviolet light is arcuate.

In yet another embodiment, the carriage assembly lens has reflective elements to direct the ultraviolet light onto the surface to be cleaned.

In yet another embodiment, the ultraviolet light element comprises a tubular body, and the ultraviolet light element is mounted to the carriage assembly adjacent the fluid distributor.

In still another embodiment, the ultraviolet light is mounted at a center of the carriage assembly to direct ultraviolet light onto the surface to be cleaned.

In yet another embodiment, the ultraviolet light is mounted on the carriage assembly for movement therewith.

In yet another embodiment, the ultraviolet light element is powered by an electrical circuit comprising contact rings.

In yet another embodiment, the electrical circuit further comprises sliding conductive contacts operatively associated with the contact rings and electrically coupled to the ultraviolet light element to conduct electricity from the contact rings to the ultraviolet light element during movement of the carriage assembly.

In yet another embodiment, the ultraviolet light element is powered by an electrical circuit comprising at least one inductive coupling.

In still another embodiment, the ultraviolet light is mounted in a compartment isolated from the opening.

In yet another embodiment, the ultraviolet light is powered by an electrical circuit, and the electrical circuit has a manually operated switch that controls the activation of the ultraviolet light.

In still another embodiment, the unattended extraction cleaning machine further comprises a controller that controls the fluid delivery system, the fluid extraction system, and the ultraviolet light according to a timed duty cycle.

In yet another embodiment, the unattended extraction cleaning machine further comprises a controller that controls the fluid delivery system and the fluid extraction system according to a timed duty cycle and further controls operation of the ultraviolet light such that the ultraviolet light operates through the entire duty cycle.

In still another embodiment, the ultraviolet light comprises an ultraviolet light element mounted on the housing and an ultraviolet light element mounted on the carriage assembly for movement therewith.

DESCRIPTION OF EMBODIMENTS OF THE INVENTION

Figure 1:
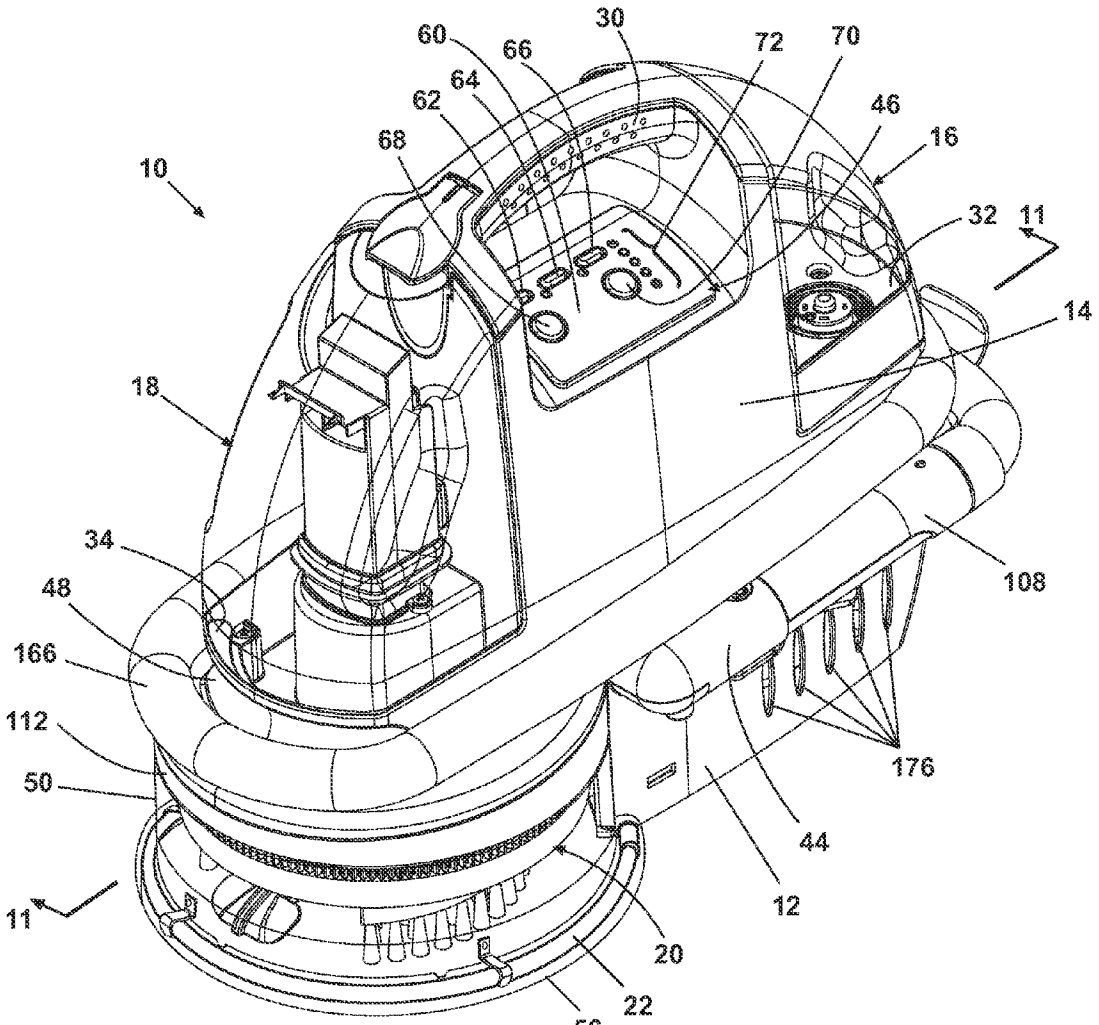
FIG. 1 is a front perspective view of an unattended spot cleaning apparatus according to the invention.
Figure 2:
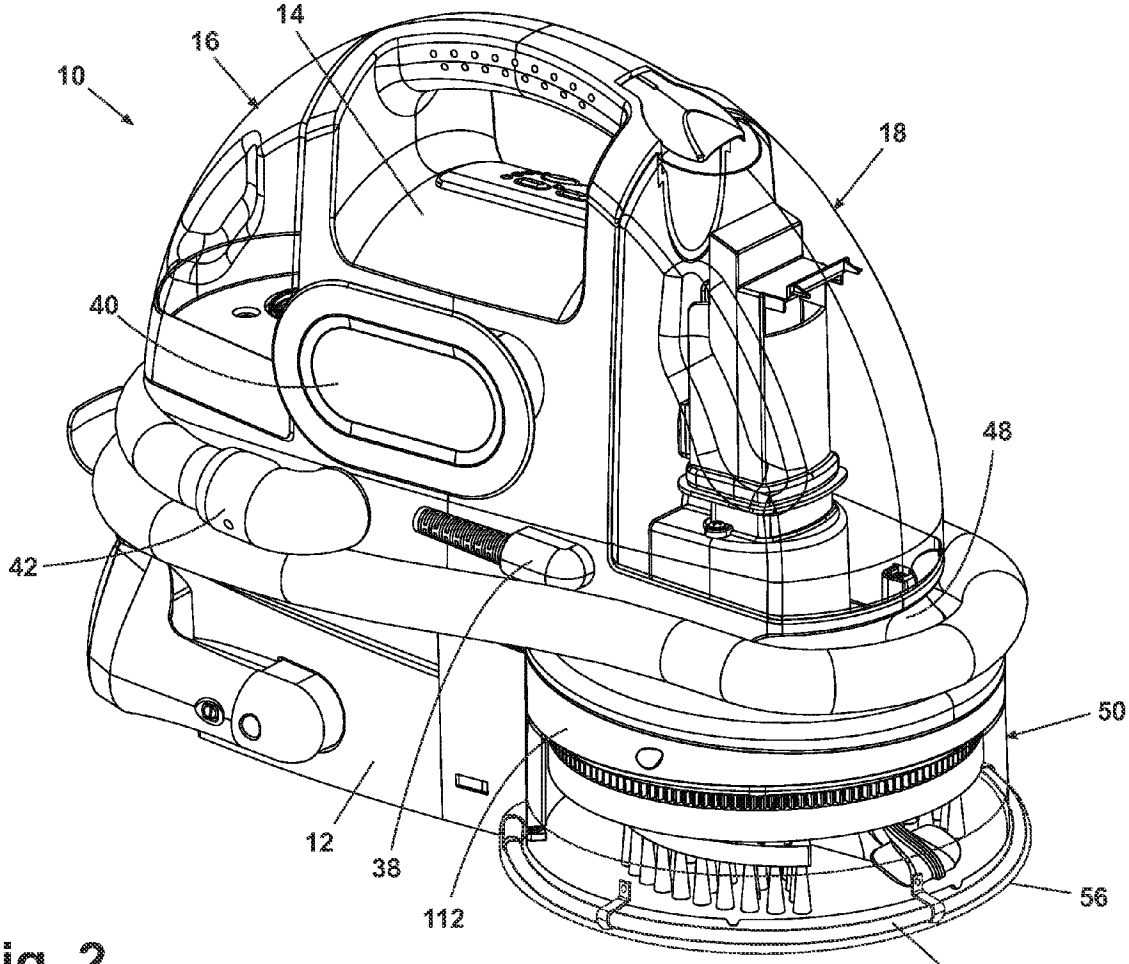
FIG. 2 is a rear perspective view of the unattended spot cleaning apparatus of FIG. 1.
Figure 3:
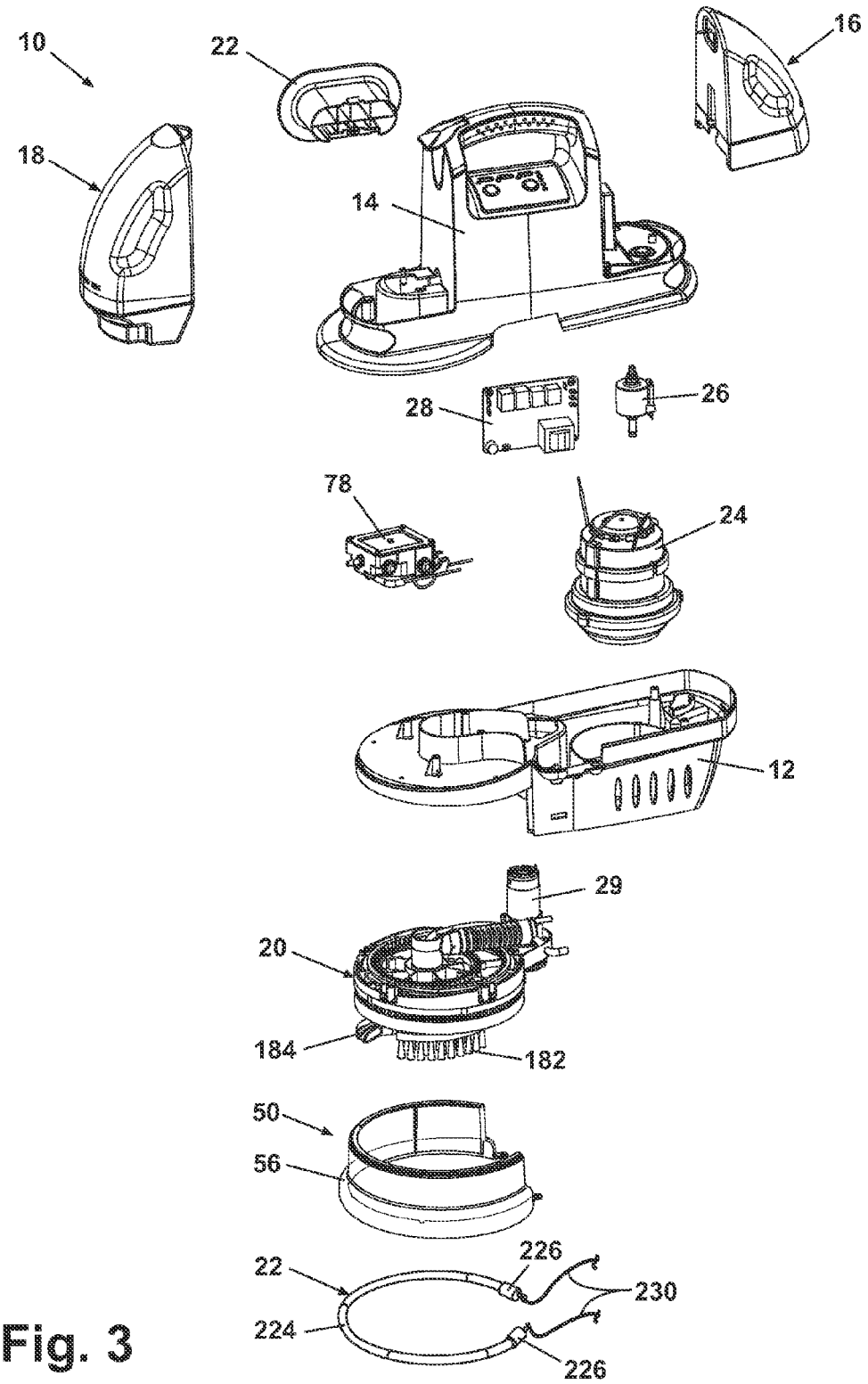
FIG. 3 is an exploded view of the unattended spot cleaning apparatus of FIG. 1.

Referring to the drawings, and in particular to FIG. 1-3, an unattended spot cleaning apparatus 10 according to one embodiment of the invention comprises a bottom housing 12, a top housing 14, a clean tank assembly 16, a recovery tank assembly 18, a carriage assembly 20, and an ultraviolet light emitting element 22. The overall structure and function is similar to that of the machine disclosed in U.S. Pat. No. 7,228,589 to Miner et al., which is incorporated herein by reference in its entirety.

The bottom housing 12 rests on a surface to be cleaned and mates to the top housing 14 to form a cavity therebetween for housing a motor/fan assembly 24, a carriage assembly drive motor 29, a pump assembly 26, a plurality of fluid delivery and recovery conduits (not shown), and a controller 28. A curved carry handle 30 can be attached at an upper surface of the top housing 14 to facilitate carrying of the apparatus 10 by a user. The carry handle 30 can be integrally formed with the top housing 14 or formed separately from the top housing 14 and attached by any suitable means, such as by welding.

The fluid recovery tank assembly 18 and the clean tank assembly 16 are removably received in recessed mounting pockets 32, 34 formed at opposite sides of a lower portion of the top housing 14. A power cord exit 38 and a cord wrap 40 are also included on the top housing 14. The top housing 14 can further comprise a suction hose fitting 42 on the backside and a grip support fitting 44 on the front side. The front and back sides are defined relative to a control panel 46, which is mounted on the top front side of the top housing 14 below the carry handle 30 for unobstructed viewing by the user. The lower portion of the top housing 14 further comprises hose recesses 48 that are formed on both sides thereof below the tank mounting pockets 32, 34.

A carriage assembly lens 50 is attached to a lower portion of the bottom housing 12 and defines a cavity or carriage assembly compartment 52 (FIG. 12) in the underside of the bottom housing 12 that receives a carriage assembly 20. In the preferred embodiment, the carriage assembly lens 50 comprises an integrally formed mounting channel 56 that extends around the bottom perimeter of the lens 50 to receive an arcuate tubular UV light emitting element 22. The carriage assembly lens 50 is preferably formed of a transparent material to permit visibility of the carriage assembly 20 and UV light emitting element 22 mounted therein. The carriage assembly lens 50 and/or mounting channel 56 can further comprise reflective elements (not shown) configured to reflect light emitted from the UV light element onto the surface to be cleaned. The reflective elements can be any elements having reflective properties, such as strips of foil or glass forms.

Referring to FIGS. 1 and 3, the control panel 46 comprises a bezel 60 to retain a first operational mode switch 62, a second operational mode switch 64, a manual switch 66, a pause/resume switch 68, a stop switch 70, and a plurality of corresponding indicator lights 72 that visually communicate the operational mode of the spot cleaning apparatus 10 to the user. The control panel 46 can contain any number of additional elements if desired. The controller 28 is located within the component mounting cavity of the top housing 14. The controller 28 comprises a conventional printed circuit board upon which well-known computer processing and electronic components are mounted, such as a microprocessor and a memory component.

The controller 28 provides conditioned output to any combination of the motor/fan assembly 24, the carriage assembly drive motor 29, the fluid solenoid pump 26, the UV light emitting element 22, and, optionally, to a steam boiler 78 and associated solenoid flow control valves or pumps. The controller 28 can utilize pre-timed programs in the fashion of a conventional laundry washing machine timing circuit. The controller output signals are also routed to a plurality of visual or audible indicators mounted to the exterior of the enclosure. Indicators can include Light Emitting Diodes (LED's) and signal tone generators. Indicators can convey information such as low fluid, the present stage of the cleaning cycle, and the like.

Figure 4:
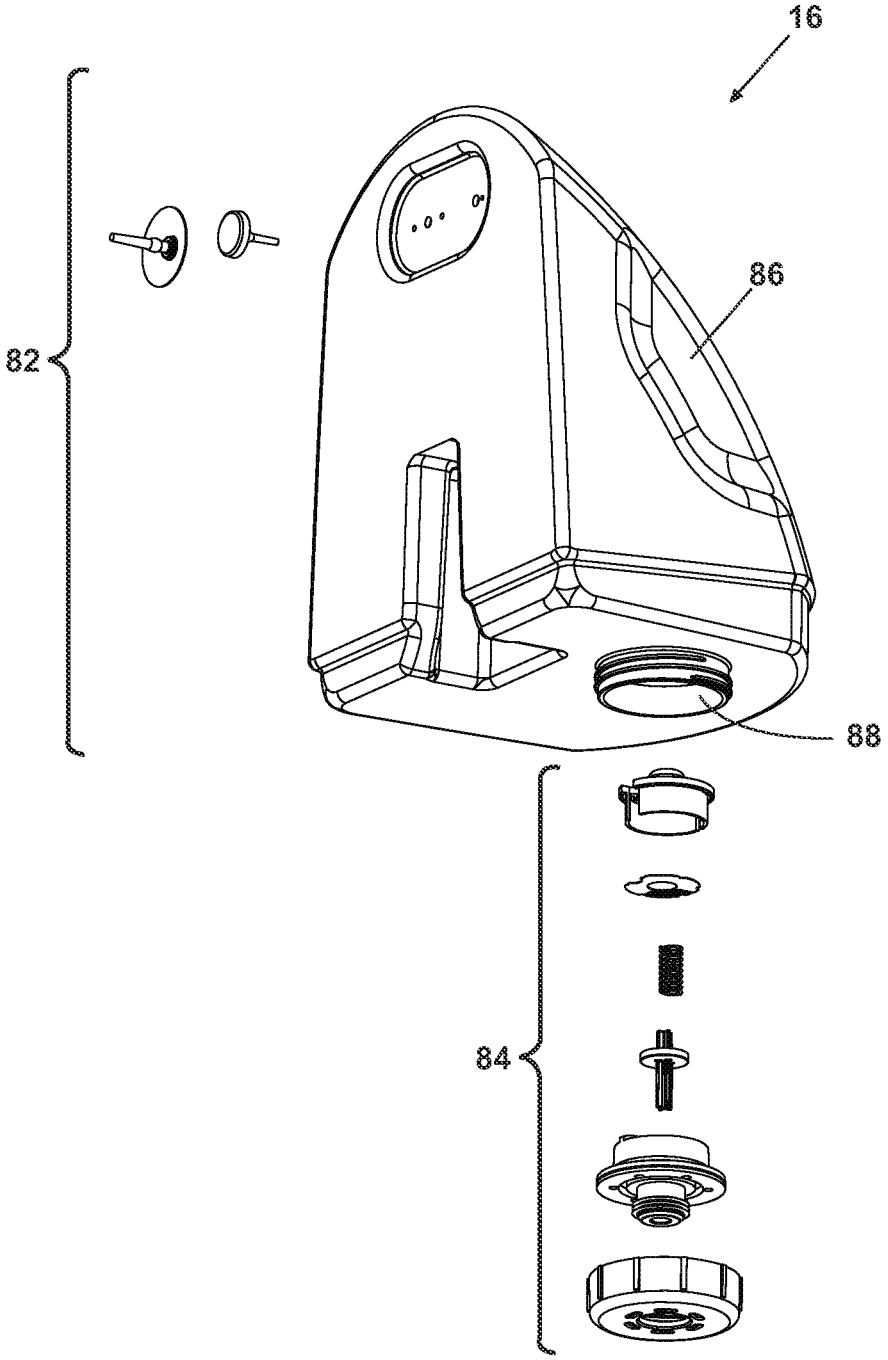
FIG. 4 is an exploded view of a clean tank assembly of the unattended spot cleaning apparatus of FIG. 1.

Referring to FIGS. 3-4, a fluid delivery system comprises the clean tank assembly 16, a pump assembly 26, a valve assembly 80, various fluid supply conduits, and at least one fluid distribution member 90. If present as shown in FIG. 3, the steam boiler 78 is incorporated into the fluid delivery system to generate steam for distribution onto a cleaning surface for disinfection/sanitization purposes. The clean tank assembly 16 comprises a fluid tank assembly 82 and a clean tank cap assembly 84. The fluid tank assembly 82 comprises a blow molded fluid tank 86 defining a cavity for storing fluid. The fluid tank assembly 82 further comprises a single outlet aperture 88 disposed on a bottom surface thereof. The outlet aperture 88 is sealingly covered by the cap assembly 84. Venting for the tank assembly 16 can be accomplished in a conventional manner, such as through the use of vent holes and commonly known umbrella valves mounted to interior and exterior upper tank surfaces thereof providing both positive and negative pressure relief to ambient atmosphere. Alternatively, the clean tank assembly 16 can comprise a dual clean tank configuration where one tank holds a chemical composition and the other tank holds clean water.

Figure 5:
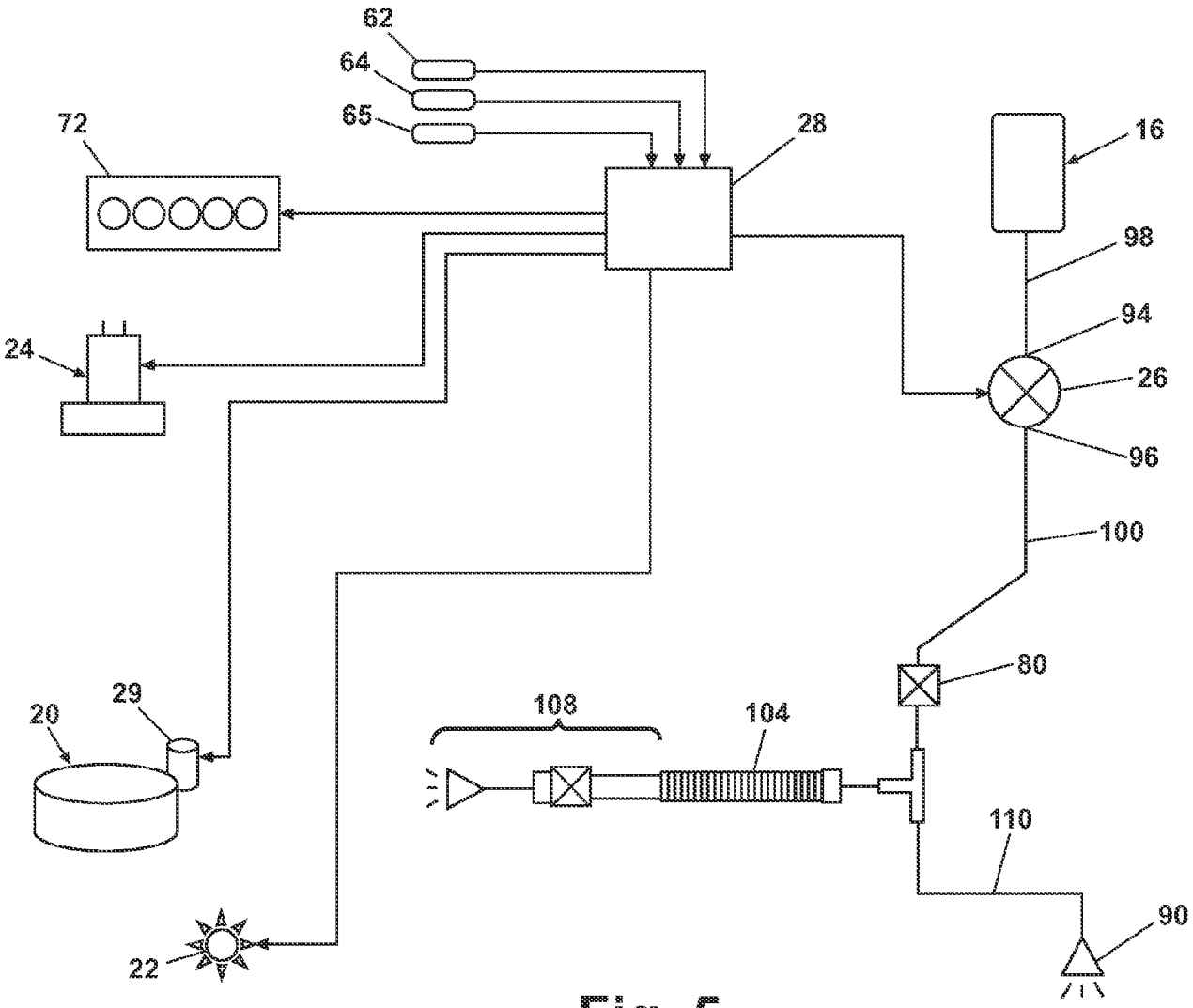
FIG. 5 is a schematic view of a fluid system and logic circuit of the unattended spot cleaning apparatus of FIG. 1.

Referring to FIGS. 3 and 5, the clean tank assembly 16 is located directly above the pump assembly 26. The solenoid pump assembly 26 is mounted to a rear surface of a motor/fan support 92 in the bottom housing 12. The fluid pump 26 comprises a pump inlet 94 and a pump outlet 96. A first fluid conduit 98 fluidly connects the tank outlet aperture 88 with the pump inlet 94 on another end. A second fluid conduit 100 fluidly connects the pump outlet 96 with a fluid fitting (not shown) within the suction hose fitting 42 (FIG. 2). A third fluid conduit (not shown) runs from the fluid fitting and along the length of the suction hose member 104. At the end of the suction hose member 104, the third fluid conduit is fluidly connected to the grip support fitting 44. A suction hose grip 108 can be coupled to the grip support fitting 44. The third fluid conduit is fluidly connected to a fourth fluid conduit 110 that is connected to the grip support fitting 44 (FIG. 1) on one end. On the opposite end, the fourth fluid conduit 110 is connected to the at least one fluid distribution member 90 preferably located underneath the carriage assembly support 112 on the bottom housing 12. At the fluid distribution member 90, the fluid is applied to the surface to be cleaned. In one embodiment, the fluid distribution member 90 is a conventional spray nozzle preferably mounted near the center of the carriage assembly 20. When the suction hose grip 108 is removed from the grip support fitting 44, the user can manually apply fluid to the surface to be cleaned.

Figure 6:
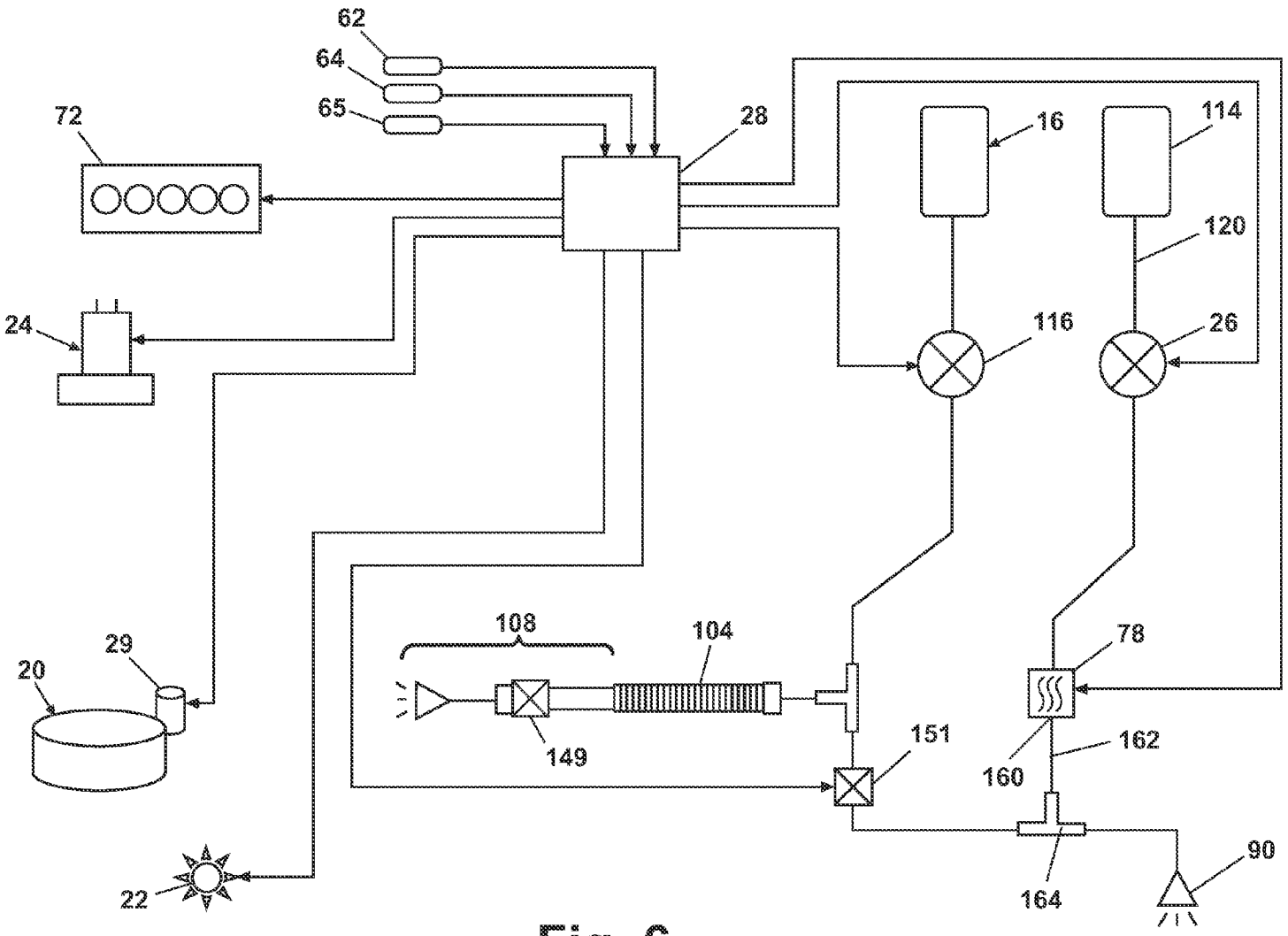
FIG. 6 is a schematic view of an alternate fluid system and logic circuit of the unattended spot cleaning apparatus of FIG. 1.
Figure 7:
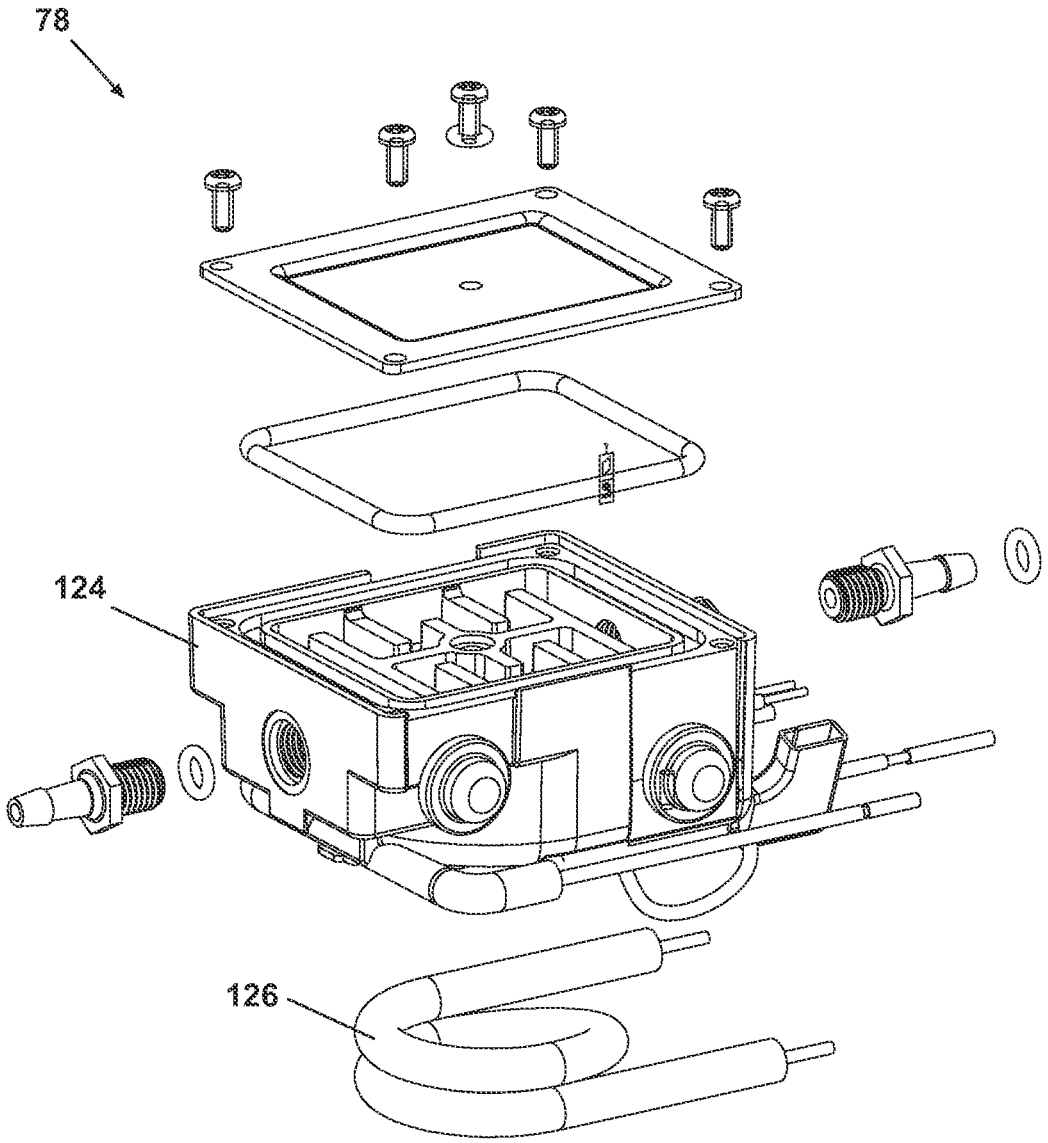
FIG. 7 is an exploded view of a steam boiler assembly of the unattended spot cleaning apparatus of FIG. 1

Referring to FIGS. 6-7, in an alternate embodiment, a steam boiler 78 and a water supply tank 114 are added to the system together with a separate clean tank assembly 16. Both tanks are mounted above a first and second dedicated solenoid pump assembly 116, 26. The clean tank assembly 16 is in fluid communication with a solenoid pump 116 that is fluidly connected to a T-fitting that can deliver fluid to the hose grip assembly 108 or the fluid distribution member 90 depending on actuation of respective fluid control valves 149, 151. The water supply tank 114 is fluidly connected to a dedicated second solenoid valve 26 that is in fluid connection to the steam boiler 78.

The steam boiler 78 is a commonly known machine and similar machines are used in commercially available steam guns, steam mops, irons and the like. A suitable steam boiler 78 can comprise a die-cast metallic heating block 124 with a fluid heating compartment formed on the interior portion for heating water to generate steam, or alternatively, heating a liquid to a temperature below its boiling point. The steam boiler 78 can further comprise a heating element 126 that is preferably cast into the heating block 124, upper and lower limit temperature control thermostats (not shown), a conventional safety shut-off fuse (not shown), and conductor wires (not shown) for connecting the thermostats and delivering power to the steam boiler 78. The conductor wires are connected to the controller 28, which can deliver appropriate output power signals to the steam boiler based on the cleaning mode selected by the user. The outlet end 160 of the steam boiler 78 is connected to a steam outlet conduit 162 that is further connected to a T-fitting in fluid communication with the fluid distribution member 90 that can deliver steam to a surface to be cleaned.

Figure 8:
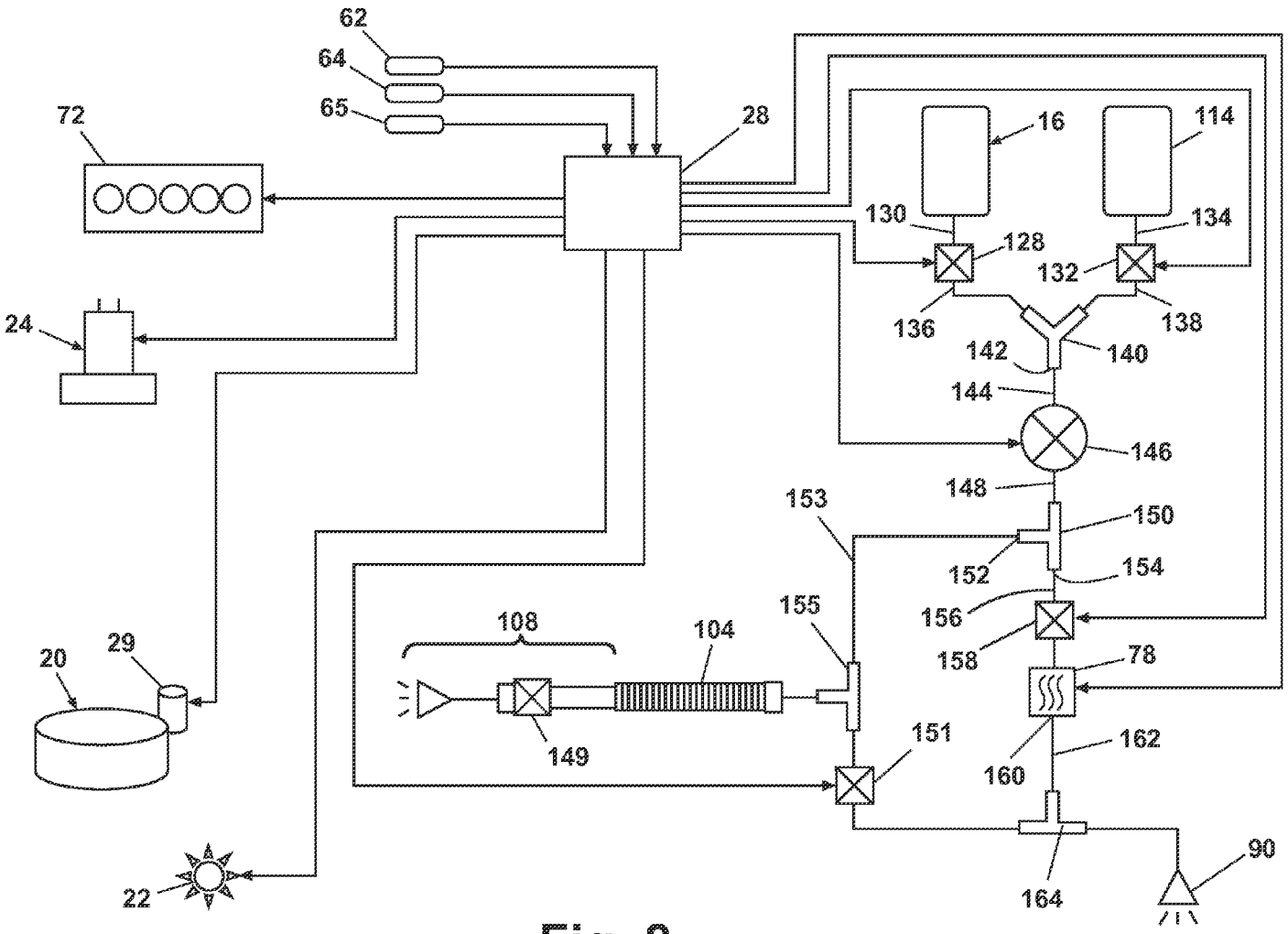
FIG. 8 is a schematic view of an alternate fluid system and logic circuit of the unattended spot cleaning apparatus of FIG. 1.

FIG. 8 shows another alternate fluid distribution system configuration that incorporates a steam boiler 78 component. In this embodiment, the clean tank 16 is fluidly connected to a commonly known first solenoid valve 128 via a chemical fluid conduit 130. A water tank 114 is fluidly connected to the inlet of a second solenoid valve 132 via a water fluid conduit 134. The outlets of first and second solenoid valves 128, 132 are connected to first and second intermediate fluid conduits 136, 138, respectively, that connect to the inlets of a Y-fitting 140. The outlet end 142 of the Y-fitting 140 is fluidly connected to a solenoid pump 146 inlet via a third fluid delivery conduit 144. The outlet end of the solenoid pump 146 is connected to a fourth fluid delivery conduit 148 in fluid communication with a first conventional T-fitting 150. A first outlet end 152 of the T-fitting 150 is connected to a fifth fluid conduit 153 that is connected to a second T-fitting 155 which delivers fluid to either the suction hose grip 108 or to the fluid distribution member 90 depending on which of two fluid control valves 149, 151 are actuated. A second outlet end 154 of the first T-fitting 150 delivers fluid to a steam inlet conduit 156 that is fluidly connected to a solenoid fluid control valve 158 to control fluid supply to the steam boiler 78. The outlet end 160 of the steam boiler 78 is connected to a steam outlet conduit 162. The steam outlet conduit 162 is in fluid connection with a third T-fitting 164 that is fluidly connected to the fluid distribution member 90. The solenoid control valves 128, 132, 158, fluid pump 146, and steam boiler 78 are all connected to the controller 28 which delivers output signals to the respective components based on the user-selected cleaning mode.

The top housing 14 further comprises a suction hose assembly 166 that can be connected to the spot cleaning apparatus 10 at both ends during automatic operation mode and can be detached at one end during manual operation mode. The suction hose assembly 166 comprises a flexible suction hose member 104 with a conventional hose connector fitting mounted at each end. One end of the hose is permanently fixed to and in fluid communication with a suction hose fitting 42 located on the backside of the top housing 14. A suction hose grip assembly 108 is fixedly mounted to the suction hose member 104 on the opposite end and is removably attached to a grip support fitting 44 located on the front side of the top housing 14. The grip support fitting 44 is secured between the top and lower housing 14, 12, and selectively retains the suction hose grip assembly 108 to the spot cleaning apparatus 10. During manual mode, the hose grip assembly 108 is detached from the grip support fitting 44 and a cleaning attachment tool can be removably mounted to the receiving end of the hose grip assembly 108 to perform various cleaning tasks in manual operation mode. When the spot cleaning apparatus 10 is in automatic cleaning mode, the hose grip 108 is connected to the grip support fitting 44 and the suction hose assembly 166 is wrapped around the spot cleaning apparatus such that the hose member 104 rests in the hose recess 48 features formed on both sides of the top housing 14.

Figure 9:
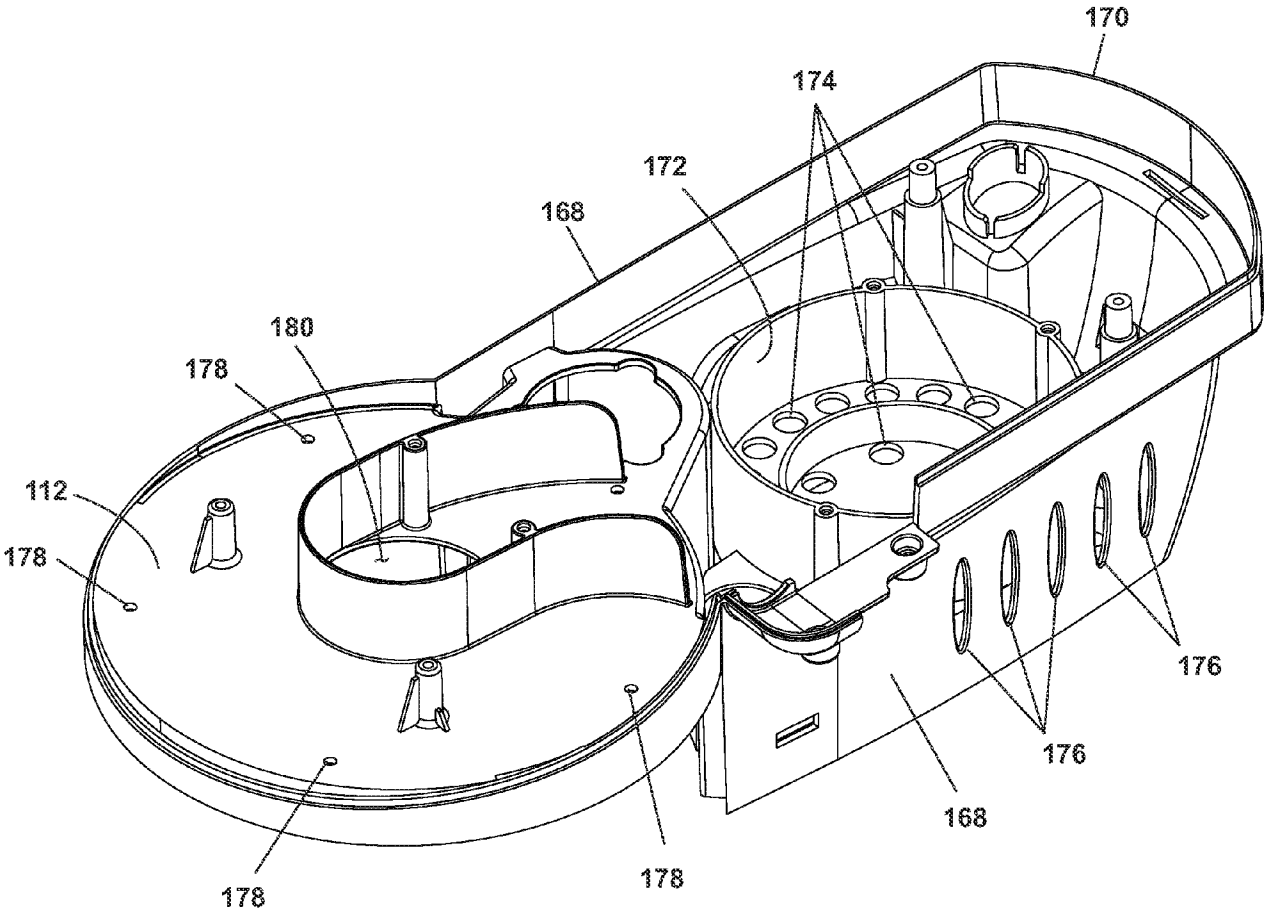
FIG. 9 is a perspective view of a bottom housing of the unattended spot cleaning apparatus of FIG. 1.

Referring now to FIG. 9, the bottom housing 12 is a generally box-like structure comprising a pair of generally vertical spaced side walls 168 connected by a slightly arcuate rear wall 170 to form a space therebetween. The bottom housing 12 further comprises a motor/fan support 172 between the side walls 168 that supports the motor/fan assembly 24. The motor/fan support 172 comprises a plurality of apertures 174 to facilitate the flow of working air, exhaust air, and cooling air through the motor/fan assembly 24. Exhaust and cooling air exits the spot cleaning apparatus 10 through a plurality of motor exhaust apertures 176 formed in the side walls 168. The motor exhaust apertures 176 are in fluid communication with the apertures 174. A platform-like carriage assembly support 112 is joined to upper edges of the side walls 168 and extends to the left of the motor/fan support 172 when viewing the spot cleaning apparatus 10 from the front side. The carriage assembly support 112 comprises a plurality of mounting apertures 178 to secure the carriage assembly 20 thereon. A central working air aperture 180 extends through the carriage assembly support 112.

Figure 10:
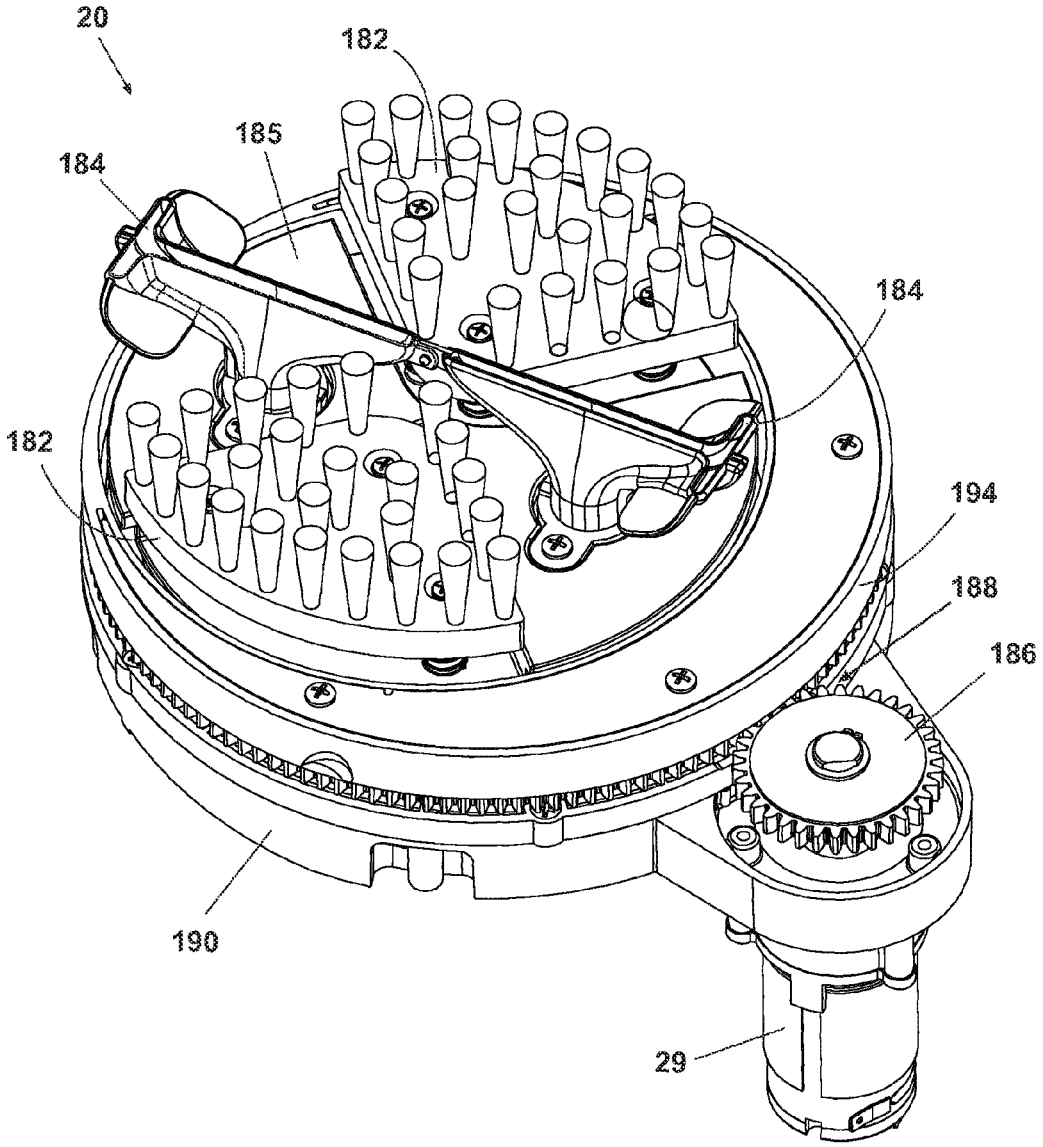
FIG. 10 is a perspective view of a carriage assembly of the unattended spot cleaning apparatus of FIG. 1.

As shown in FIG. 10, the carriage assembly 20 comprises a plurality of agitation assemblies 182 and suction nozzle assemblies 184 mounted to an agitation plate 185 and forming an agitation plate assembly 183. The agitation and nozzle assemblies 182, 184 are operably connected to a drive motor pinion gear 186 via a gear train 188. The gear train 188 comprises a main ring gear 190, a pinion gear assembly 192, and a drive plate assembly 194. A suitable carriage assembly 20, assembled configuration, and operation is disclosed in the Miner et al. '589 patent. The suction nozzle assemblies 184 are fluidly connected to the fan/motor assembly 24 through a working air path and fluid recovery system that will now be described.

Figure 11:
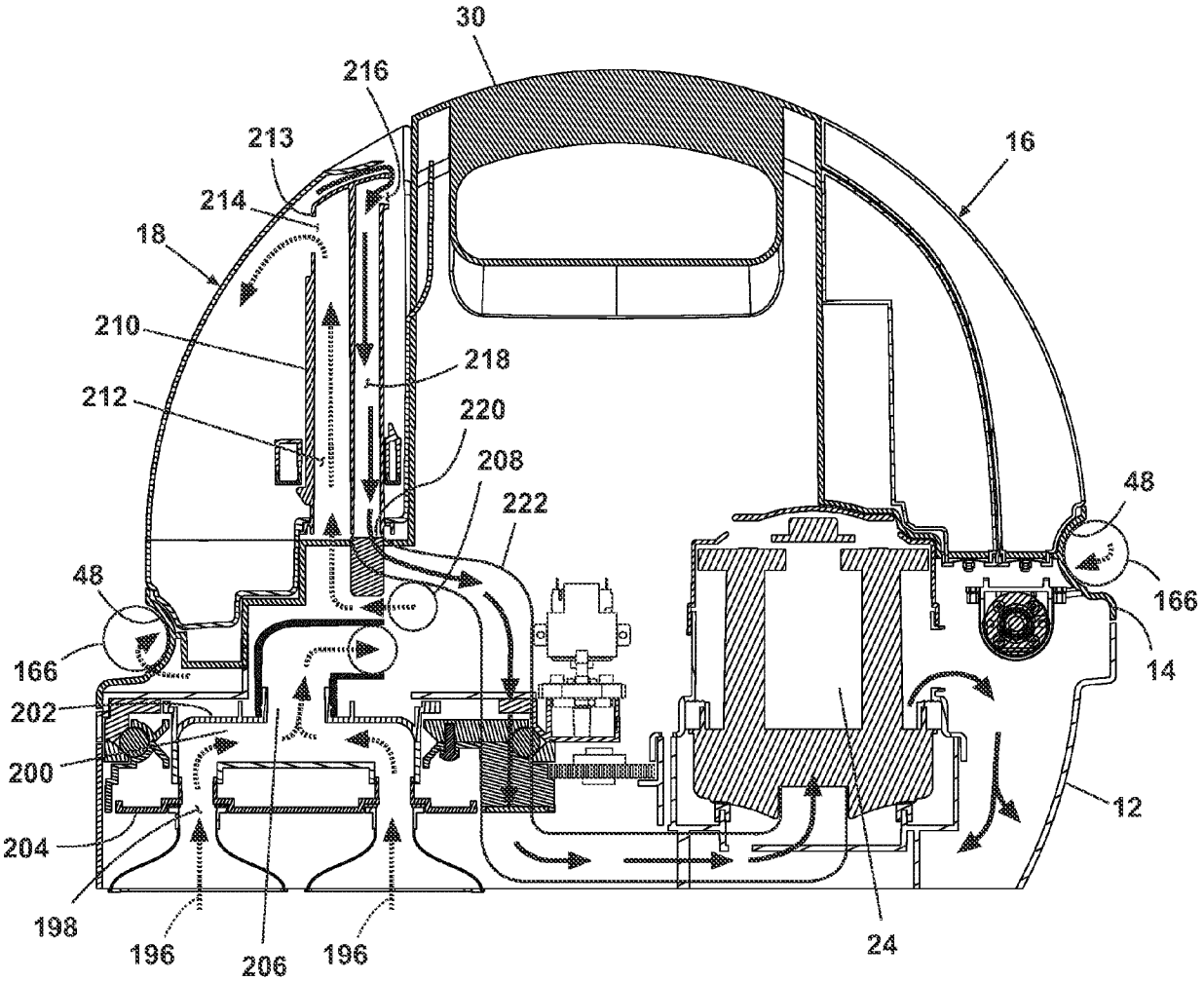
FIG. 11 is a sectional view of the unattended spot cleaning apparatus taken along line 11-11 of FIG. 1.

Referring now to FIG. 11, and as disclosed in the Miner et al. '589 patent, the fluid recovery system comprises a motor/fan assembly 24 in fluid communication with a suction nozzle inlet 196 having an inlet end in communication with a surface to be cleaned and an outlet end 198 in fluid communication with a working air plenum 200 defined between and upper pinion gear 202 and a lower pinion plate 204. The working air plenum 200 outlet is fluidly connected to the inlet end of a swivel fitting 206 having an outlet end in fluid connection with a flexible hose (not shown). The flexible hose is connected to the swivel fitting 206 on the inlet end and a suction hose fitting 42 on the outlet end. A suction hose assembly 166 is fluidly connected to the suction hose fitting 42 on one end and removably connected to a grip support fitting 44 on another end.

When the spot cleaning apparatus 10 is operated in manual mode, the user removes the suction hose grip assembly 108 from the grip support fitting 44 and maneuvers the suction hose grip 108 and any tools attached thereto over the surface to be cleaned in a conventional manner. When the cleaning apparatus 10 is operated in automatic or unattended mode, the suction hose grip 108 remains connected to the grip support fitting 44 to fluidly connect the working air path from the suction hose assembly 166 through the suction hose grip 108 and grip support fitting 44 to a fixed working air conduit (not shown) positioned within the bottom housing 12. The fixed working air conduit (not shown) is coupled with a working air inlet 208 on a standpipe 210 in the recovery tank 18. The working air moves up through a dirty air path 212, impacts a deflector 213, and exits the standpipe 210 through a dirty air exhaust aperture 214 where solid debris falls from the air and settles under force of gravity to the bottom of the recovery tank 18. The clean air is then drawn into a clear air inlet aperture 216, down a clean air path 218 of the standpipe 210, out a clean air outlet 220, and into a clean air conduit 222 that is fluidly connected to an inlet on the motor/fan assembly 24. Exhaust air from the motor/fan assembly 24 exits the bottom housing 12 through the exhaust air apertures 176.

Figure 12:
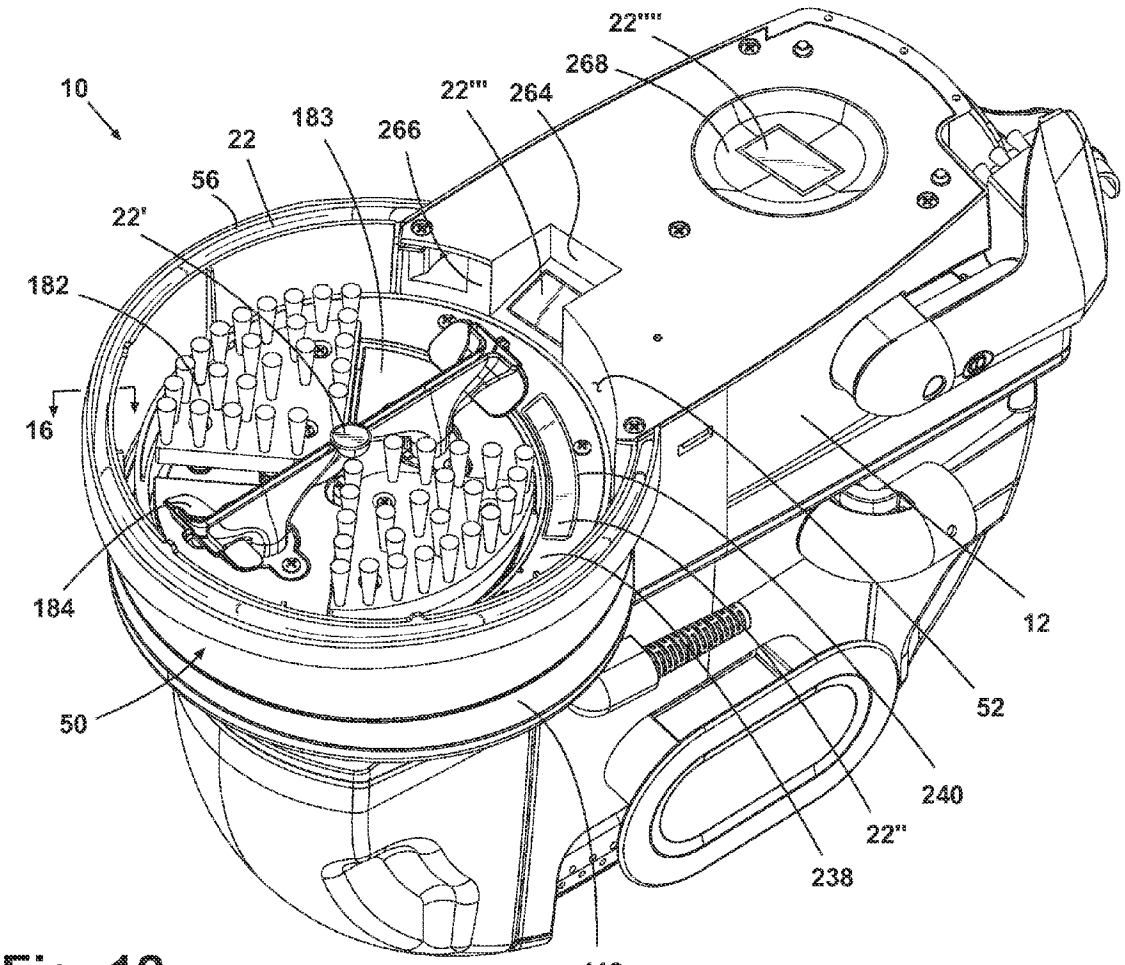
FIG. 12 is a bottom perspective view of the unattended spot cleaning apparatus of FIG. 1.

Now referring to FIGS. 3 and 12, the UV light emitting element 22 preferably comprises a conventional UV lamp. The UV light emitting element 22 can further comprise an arcuate tubular glass body 224 that is enclosed by ceramic end fitting assemblies 226. Alternately, the UV light emitting element 22 can comprise a straight UV lamp assembly or a plurality of UV emitting LEDs. Each end fitting assembly 226 comprises a ceramic housing that secures an electrode (not shown). Each electrode is connected to a conductor wire 230 that extends outwardly from the end fitting 226. In the preferred embodiment, the UV light emitting element 22 is fixedly received within the mounting channel 56 that is integrally formed in the lower portion of the carriage assembly lens 50 as shown in FIG. 12. The conductor wires 230 extending from each end of the light emitting element 22 are routed through slots 232 formed in the bottom housing 12 that provide access to the interior portion of the bottom housing 12. The conductor wires 230 are routed through the interior portion of the bottom housing 12 and are connected to power output terminals (not shown) on the controller 28 that selectively provide power to the UV light emitting element 22. The controller 28, in turn, has input terminals (not shown) that are connected to output terminals (not shown) on the control panel 46 via known electrical conductors (not shown).

The UV light emitting element 22 can be selected from a range of optional light emitting elements based on the desired effect and dictated by the wavelength properties associated with the light element. For example, in the preferred embodiment, the light emitting element emits UVC light which can provide surface sanitization and disinfection properties. It is well-known that UVC light exposure has a germicidal effect and can eradicate odor-causing bacteria by destroying the DNA and RNA of microbes, thus rendering them impotent and unable to multiply. Surface sanitization and disinfection is best achieved with a light source having a UVC wavelength of about 260 nanometers. However, a range of about 280 to about 200 nanometers is also acceptable. Some UVC-emitting light systems also produce visible light in the blue-green spectrum, which is helpful for illumination and user-feedback purposes. Alternatively, the light emitting element can be selected to enhance stain removal performance or activate certain cleaning chemical compositions. The light emitting element can also be selected to offer carbon-based stain detection properties. Light in the UVA range comprising a wavelength from about 400 nanometers to about 320 nanometers (also known as "black light") is effective for illuminating carbon-based stains, including pet stains such as urine stains. UVA light causes carbon-based stains to fluoresce, thus making the otherwise invisible stain visible to the eye. Furthermore, it is known that illuminating certain peroxygen cleaning compounds with UVA light can improve cleaning efficacy and decrease the cleaning cycle time.

Figure 13:
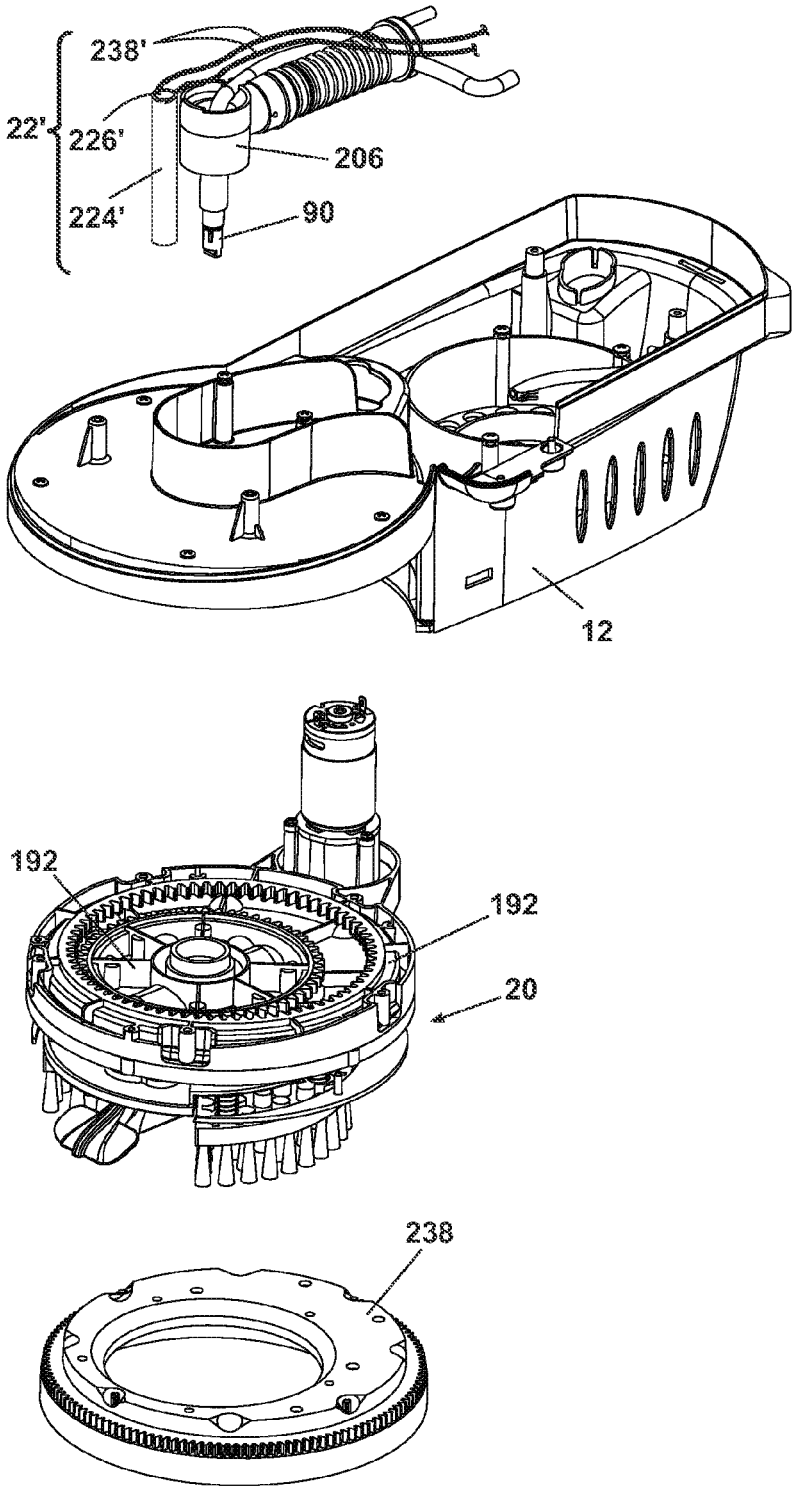
FIG. 13 is a partial exploded view of the unattended spot cleaning apparatus of FIG. 12.
Figure 14:
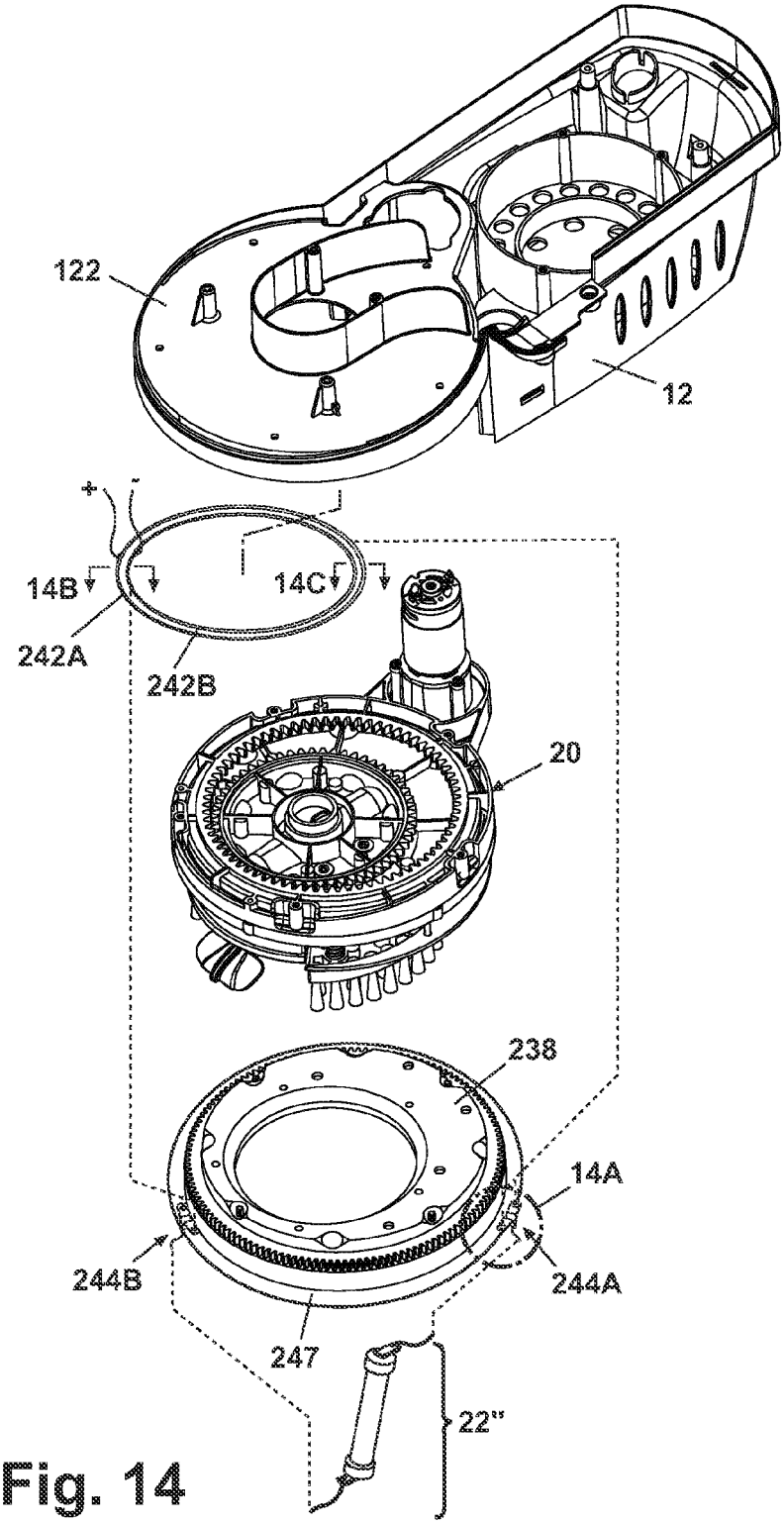
FIG. 14 is a partial exploded view of the unattended spot cleaning apparatus of FIG. 12.
Figure 14A:
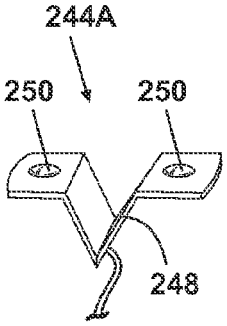
FIG. 14A is a perspective view of a first sliding contact of FIG. 14.

An alternate embodiment shown in FIGS. 12-14 comprises a UV light emitting element 22' mounted onto the swivel fitting 206 and extending downwardly from the center of the carriage assembly support 112 such that the UV light emitting element 22' is fixed adjacent to the fluid distribution member 90. The UV light emitting element 22' in this configuration comprises a straight tubular body 224' with one open end attached to a single end fitting 226' with conductor wires 238' extending from a backside and connecting to the controller 28. The conductor wires are routed through the bottom housing and connected to the controller 28 in a fashion similar to that previously described. Various internal components of the carriage assembly 20 require modification in order to permit adequate clearances for the center-mounted UV light emitting element 22'. Internal components include the agitation support plate, brush housings, lower pinion plate, upper pinion gear, and swivel fitting 206. This alternate UV light mounting position near the center of the carriage assembly mounting cavity is advantageous because it allows more direct UV light exposure to the surface being cleaned. An additional benefit associated with this alternate configuration is related to mounting the UV light and conductor wires to the swivel fitting 206. The exterior surface of the swivel fitting 206 does not spin completely about its vertical axis and thereby alleviates conductor-wear problems associated with mounting electrical components and associated electrical conductors to moving parts. When the swivel fitting 206 is used as the mounting surface for the UV light, problems like conductor twisting, abrasion, and breakage due to excessive flexing can be avoided, thereby providing a robust, reliable design.

Also shown in FIGS. 12-14 is a UV light emitting element 22" mounted to the rotating bottom drive gear plate 238. A mounting pocket 240 is formed in the bottom surface of the bottom drive gear plate 238 and further comprises a conductor wire access slot (not shown). The UV light emitting element 22" can be retained in the mounting pocket 240 via detachable mounting brackets, a supportive lens cover, snap structures formed integrally on the bottom drive gear plate 238, or any other suitable means. Power is not provided to the UV light emitting element 22" via traditional conductor wires because, during operation, the lighting element rotates continuously about the vertical axis of the bottom drive gear plate 238. This rotation creates challenges, including conductor wire wear, wire twisting, and wire breakage. Instead, alternative power transfer means must be employed.

Figure 14B:
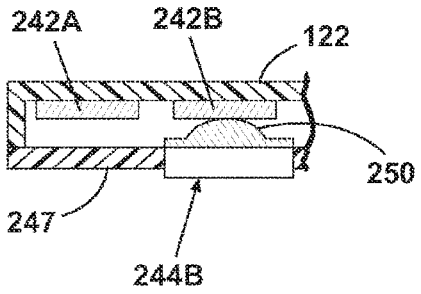
FIG. 14B is a sectional view of the connection between a contact ring and an additional sliding contact taken along the line 14B of FIG. 14.
Figure 14C:
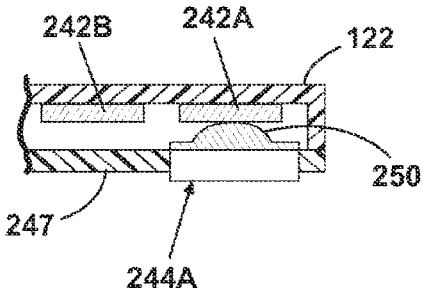
FIG. 14C is a sectional view of the connection between an additional contact ring and the first sliding contact taken along the line 14C of FIG. 14.

As best illustrated in FIGS. 14-14C, the preferred power transfer method is via a combination of stationary conductive contact rings 242A, 242B, and sliding conductive contacts 244A, 244B. In the figures, 242A represents the contact ring electrically connected to a positive terminal, and 242B represents the contact ring electrically connected to a negative terminal. Likewise, 244A represents the conductive contact electrically connected to a positive terminal, and 244B represents the conductive contact electrically connected to a negative terminal. This is a known electricity transfer technology and is commonly employed on commercially available retractable power cord reel assemblies that can be found in certain canister vacuum cleaners and the like. In the preferred embodiment, a pair of conductive contact rings 242A, 242B is rigidly mounted to the bottom side of the carriage assembly support 112 in a planar, concentric orientation. Wire conductors are permanently attached to the backside of each contact ring and extend through access holes formed in the top surface of the carriage support 112 and route through the interior portion of the bottom housing 12 ultimately connecting to power output terminals on the controller 28. The controller 28 can selectively energize the contact rings based on input signals received from the operation mode selector switches 62, 64 housed in the control panel 46.

Referring now to FIGS. 14B and 14C, sliding conductive contacts 244A, 244B are fixedly attached to a flange 247 on the bottom drive gear plate 238 and rotate together with the plate during operation. Each sliding conductive contact 244A, 244B maintains a sliding connection with a corresponding conductive contact ring 242A, 242B during rotation. The sliding conductive contacts 244A, 244B preferably comprise a substantially v-shaped resilient metal stamping 248 with raised circular contact pads 250 that extend upwardly from each end of the sliding contact 244. Each sliding contact 244A, 244B is connected to a conductor wire at a bottom side and positioned such that sliding contact is made with a conductive contact ring 242A, 242B on the top side. Each conductor wire 245 extending outwardly from the bottom surface of each sliding conductive contact 244A, 244B is further attached to the appropriate positive or negative terminal of a UV-emitting light element 22" or, optionally, a light socket that houses a plurality of UV light emitting elements.

Figure 16:
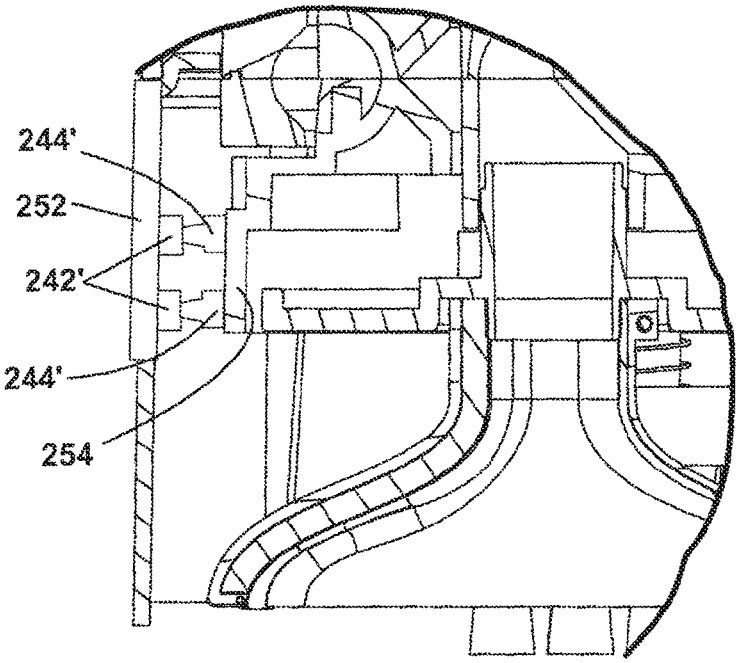
FIG. 16 is sectional view of the unattended spot cleaning apparatus taken along line 16-16 of FIG. 12.

Alternate orientations and configuration of the conductive contact rings and sliding contacts are contemplated. For example, as shown in FIG. 16, contact rings 242' can be arranged in a vertical orientation and attached to the inside surface of a vertical flange 252 that extends downwardly from the carriage support 112. The sliding contact pads 244' can be connected to the surface 254 forming the outer perimeter of the bottom drive gear plate 238, thereby creating an annular sliding electrical contact junction.

In addition to the conductive contact ring and sliding contact configuration, an alternate power transfer means is also possible and can comprise wireless electricity transfer through an inductive coupling.

Figure 15:
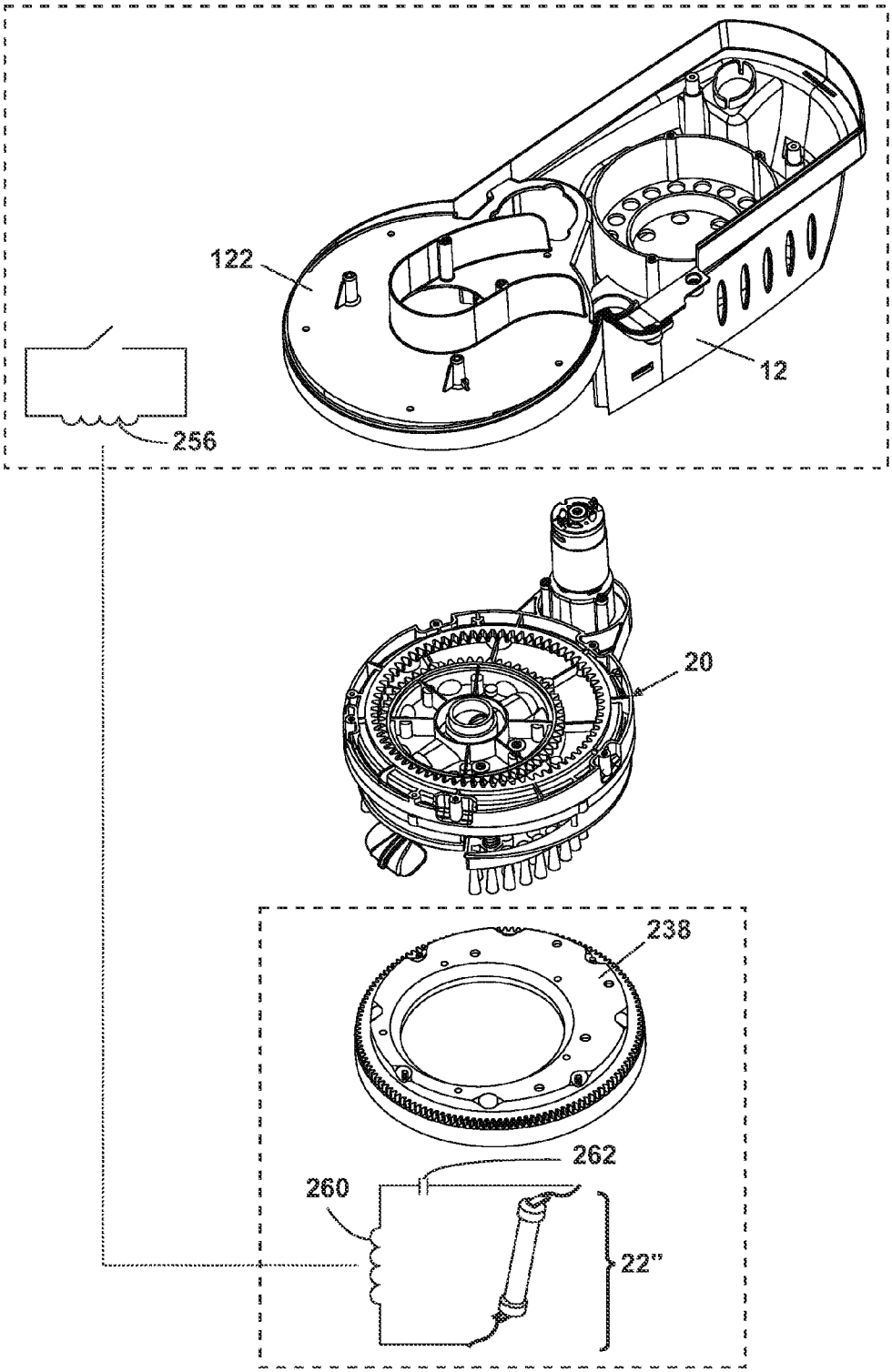
FIG. 15 is partial exploded view of the unattended spot cleaning apparatus of FIG. 12.

Referring to FIG. 15, a UV light emitting element 22" can be adapted to inductively receive power from a primary inductor coil 256, thereby eliminating the need for physical electrical conductors or conductive contacts in sliding conductive connection with mating contact rings. A suitable inductively powered lamp assembly is described in U.S. Pat. No. 6,731,071 to Baarman and is incorporated by reference herein in its entirety. In this embodiment, the primary inductor coil 256 can be mounted above the carriage platform 112 in a suitable mounting pocket (not shown) and connected to the controller 28 via conductor wires routed through the interior portion of the bottom housing 12. The controller 28 can selectively provide power to the primary inductive coil 256 based on input signals received from operation mode selection switches 62, 64 housing in the control panel 46. The modified UV light emitting element 22" can be mounted in a receiving pocket formed in the bottom drive gear plate 238 as previously described. The modified UV light emitting element 22" comprises a known UV light emitting element as previously disclosed together with a secondary inductor coil 260 and capacitor 262 connected in series with the UV light emitting element 22. When power is selectively applied to the primary inductor coil 256 via the controller 28, a magnetic field is created which thereby induces voltage to flow through the secondary inductor coil 260 and thereby energizes the UV light emitting element wirelessly.

FIG. 12 also shows a stationary UV light emitting element 22''' rigidly mounted to the bottom housing 12 in a mounting cavity 264 formed at the center of a front arcuate wall 266 that further defines the carriage assembly compartment 52. The mounting cavity 264 receives a UV light emitting element 22''' as previously described. Power input conductors extend outwardly from end fittings attached to the UV light emitting element 22''' and extend through access holes (not shown) formed in the mounting cavity 264 and through the housing 12 for connection to the controller 28, which selectively supplies power to the UV light emitting element 22'''. The UV light emitting element 22''' can be used alone or in combination with any rigidly mounted or rotatably mounted UV light emitting element 22, UV light emitting element 22', and/or UV light emitting element 22".

FIG. 12 shows a stationary UV light emitting element 22'''' received in a bottom mounting pocket 268 formed on the bottom surface of the bottom housing 12 that is completely isolated from the carriage assembly mounting cavity 264. For this UV element, electrical conductor wires are routed through the bottom housing in known fashion and connected to the controller 28. The UV light emitting element 22'''' can be used alone or in combination with UV light emitting element 22, UV light emitting element 22', UV light emitting element 22" and/or UV light emitting element 22'''.

Figure 18:
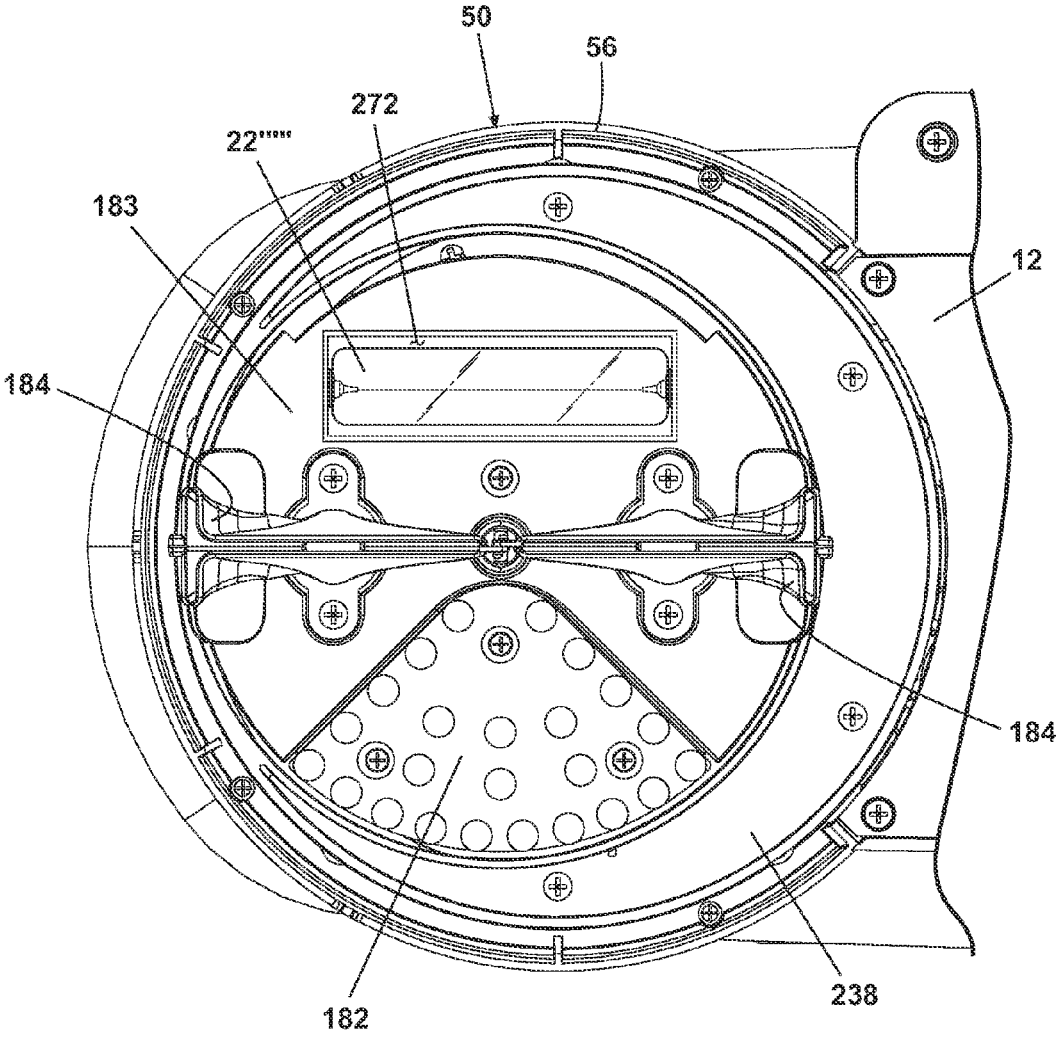
FIG. 18 is a bottom view of the unattended spot cleaning apparatus of FIG. 12 having one agitation assembly replaced with a UV light emitting element.

FIG. 18 shows another UV light emitting element 22''''' that can replace one of the agitation assemblies 182. The UV light emitting element 22''''' comprises one or more UV bulbs mounted in a mounting cavity 272 formed in the agitation plate assembly 183. The UV light emitting element 22''''' is adapted to move with the carriage assembly 20 in an orbital cleaning path in a manner similar to the agitation assembly 182. The UV light emitting element 22''''' can be used alone or in combination with UV light emitting element 22, UV light emitting element 22', UV light emitting element 22", UV light emitting element 22''', and/or UV light emitting element 22''''.

The unattended spot cleaning apparatus 10 can further comprise a steam boiler 78 incorporated into the fluid delivery system to offer improved surface sanitization properties. In a fifth alternate embodiment, the steam boiler 78 can be used in combination with or in lieu of any of the aforementioned UV light emitting element configurations to offer improved surface sanitization and bacteria eradication performance.

The unattended cleaning apparatus 10 can be operated as an unattended spot cleaner or as a manual spot cleaner. In operation, the user prepares the spot cleaning apparatus for use by placing a pre-filled clean tank assembly 16 or plurality of tank assemblies on the top housing 14 into a mounting pocket 32 above the pump assembly 26. When the clean tank assembly 16 is mounted onto the top housing 14, a plunger valve in the cap assembly 84 opens and umbrella valves automatically open for fluid flow. The user positions the unattended cleaning apparatus 10 over the spot to be cleaned so that the agitation plate assembly 183 is centered over the spot. The user plugs the power cord into a convenient receptacle and selects a desired duty cycle by pressing one of the switches 62, 64 located on the control panel 46, or, alternatively by pressing the manual switch 65 for manual mode. Upon activation of the operational mode switches, output signals are delivered to the controller 28 via a conductive wiring harness (not shown). The controller 28 provides conditioned power output to any combination of the motor/fan assembly 24, carriage drive motor 29, the fluid pump(s) 26, 116, 146 the fluid solenoid control valve(s) 80, 128, 132,158, the UV light emitting element 22, the optional steam boiler 78, as well as the appropriate indicator lights 72 that communicate the operational mode to the user.

In the preferred embodiment, during a typical automatic cleaning cycle, the UV light emitting element 22 receives a power output signal from the controller 28 and is energized continuously throughout the entire cycle. Furthermore, in order to achieve the best sanitization/disinfection efficacy, the UV light emitting element 22 is preferably positioned in close proximity to or even pushed into the surface to be cleaned to maximize contact with odor causing bacteria which often reside at the base of carpet fibers or in the carpet backing surface. The reflective elements also help to direct light emitted by the UV light emitting element onto the surface to be cleaned.

In the preferred embodiment, a first solenoid pump 116 receives an output signal from the controller 28 and cleaning fluid is drawn from the chemical tank 16, through the first solenoid pump 116. The cleaning fluid is expelled through either the fluid distribution member 90 near the carriage assembly 20 during automatic mode or selectively from the hose grip assembly 108 during manual mode. When the steam boiler 78 and second solenoid pump 26 receive simultaneous power output signals from the controller 28, clean water is drawn from the water supply tank 114, through a water conduit 120 into the second solenoid pump assembly 26 and delivered to the heating compartment of the steam boiler 78 where the water is heated into steam and expelled out of the steam boiler 78 through a steam conduit 162 and delivered to a surface to be cleaned through the fluid distribution member 90 to sanitize the surface to be cleaned. Alternatively, a single solenoid pump can selectively draw fluid from either the chemical tank 16 or the water tank 114 depending on whether a first or second dedicated fluid delivery valve 128, 132 has been actuated/opened.

When the motor/fan assembly 24 is energized, a working air flow is generated which draws fluid from the surface to be cleaned, through the suction nozzle assemblies 184 and working air conduit (not shown), and into the recovery tank 18 where the soiled liquid is separated from the working air. The working exhaust air is directed into an exhaust chamber containing exhaust apertures 176 that direct the air to ambient surroundings. The controller 28 also selectively delivers power to the carriage assembly drive motor 29, which drives the gear train 188 and subsequently moves the suction nozzle assemblies 184 and agitation assemblies 182 in an orbital cleaning path. Power to the UV light emitting element 22 can be provided via direct connection to the controller 28 through commonly known conductor wires, or, alternatively via a rotational/sliding contact arrangement. The use of contact rings 242 and sliding contacts 244 allow the UV light emitting element 22 to be mounted on a rotating member such as the bottom drive gear plate 238 while the conductor wires connected to the output terminals on the controller 28 remain stationary. In operation, upon receiving output signals from mode switches 62, 64, 66 mounted in the control panel 46, the controller 28 selectively delivers power to the conductive contact rings 242 that are slidingly connected to the sliding conductive contacts 244. Electricity is transferred through the sliding junction, through the connected conductor wires 230 and to the UV light emitting element 22, thereby powering and illuminating the element. The UV light emitting element 22 can rotate around a central axis that bounds the orbital cleaning path followed by the agitator and suction nozzle assemblies 182, 184 thereby providing UV light exposure inside the carriage assembly compartment 52. Alternatively, power can be transferred wirelessly when inductive power transfer is employed. In this configuration, power is delivered from the controller output terminal, through commonly known electrical conductors to a primary stationary inductor coil 256. The primary inductor coil generates a magnetic field that, in turn, generates a voltage in a secondary inductor coil 260 that is mounted in a separate circuit and further assembled to a moving component such as the bottom drive gear plate 238.

When the UV light emitting element 22 is mounted within a pocket 268 formed on the bottom side of the bottom housing 12 and isolated from the carriage assembly compartment 52 as discussed previously herein, a user initiates an automatic cleaning cycle. Upon completion of the cleaning cycle, the user lifts the spot cleaning apparatus 10, rotates the apparatus 180 degrees, and then places the apparatus 10 upon the extracted area such that the UV light emitting element 22 mounted in the bottom mounting pocket 268 is positioned directly over the previously extracted area. The user then actuates an individual UV light power switch 270 that can be located on the control panel 46 or elsewhere on the top housing 14. The switch 270 delivers an output signal to the controller 28, which then delivers a power output signal to the UV light emitting element 22, which activates the light for a specified period of time to facilitate sanitization and disinfection of the cleaning surface.

Figure 17:
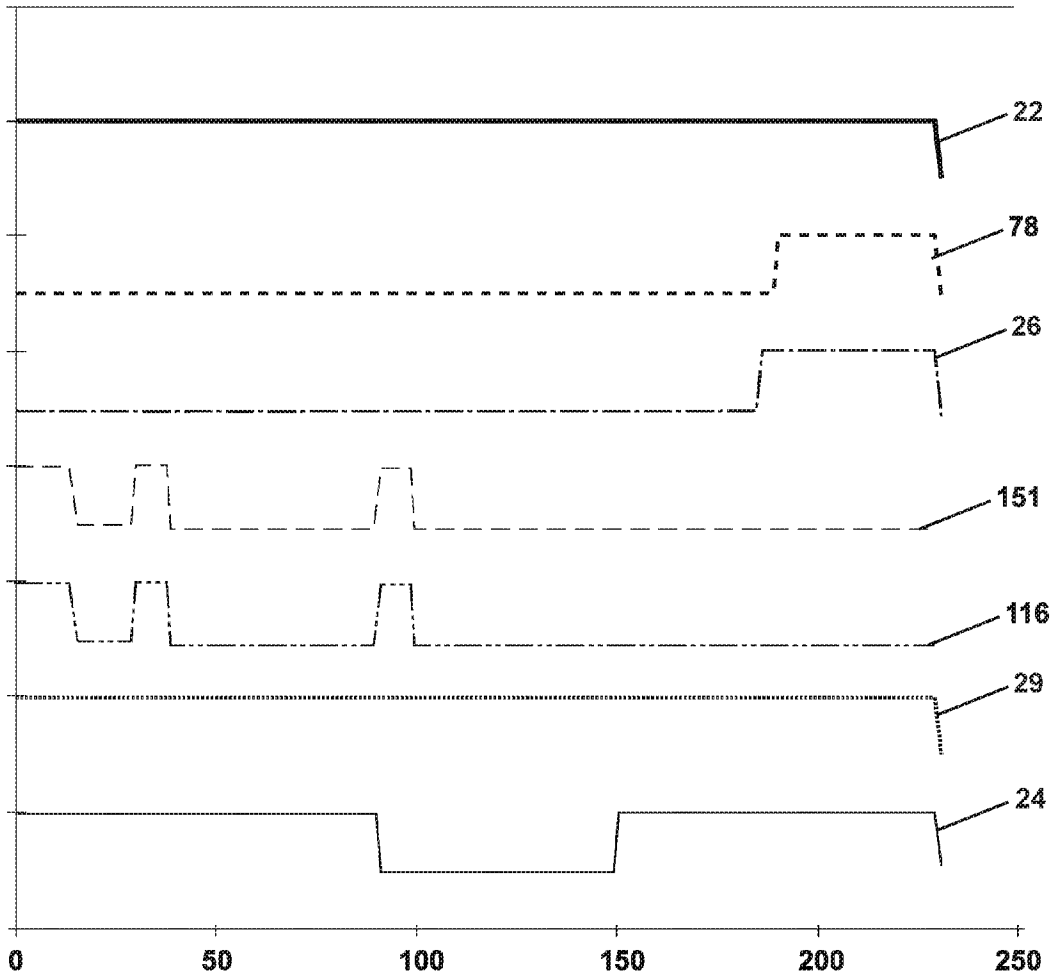
FIG. 17 is an exemplary graph of dwell time for powered components of the unattended spot cleaning apparatus shown in FIG. 1.

A graph depicting dwell time for powered components of the unattended spot cleaning apparatus 10 during an exemplary light duty UVC sanitization cycle is presented in FIG. 17. During the light duty cycle, fluid can be delivered in three separate applications while simultaneously extracting spent fluid for approximately 60 and 90 second suction intervals. Preferably, one half of the available fluid is dispersed immediately upon activation of the spot cleaning apparatus 10, followed by two additional fluid applications cycles, wherein each additional fluid application cycle delivers approximately one quarter of the initial volume. Preferably, the cleaning fluid is delivered at a flow rate of 1000 mL/minute. As schematically indicated by the dwell time in FIG. 17 for the solenoid valve 151 and the fluid pump assembly 116, the preferred fluid delivery cycle comprises 14 seconds on, 16 seconds off, 7 seconds on, 53 seconds off, and a final 7 seconds on. The carriage assembly drive motor 29 runs constantly throughout the light duty cycle to constantly move the agitation plate assembly 183 and can rotate in both forward and reverse directions depending on cycle definition. The UV light emitting element 22 is preferably energized throughout the entire cleaning cycle as well to achieve for most effective sanitization performance. Suction from the motor/fan assembly 24 remains active except for 60 seconds between the 90 second and 150 second intervals. The optional steam boiler 78 can be activated such that steam is applied to the cleaning surface during the last 30 seconds of the cycle.

The controller 28 can activate the steam boiler 78 or the heating block 124 from about 5 seconds to about 3 minutes prior to beginning the selected duty cycle and preferably for about 30 seconds prior to beginning the selected duty cycle. When the steam boiler 78 is employed, it is preferred to pre-heat the boiler 78 prior to introducing solution so that steam will flash when the solution contacts the heated boiler 78. When the heating block 124 is employed, solution remains in the heating block 124 during the pre-heat so that heated solution is available on demand during the duty cycle. The total duration of the light duty cycle is approximately 4 minutes. An exemplary heavy duty cycle completes two of the aforementioned cycles in series for a total run time of about 8 minutes. Alternative duty cycles can be programmed into the controller 28 to vary the fluid delivery, agitation, UV light exposure, steam application, and suction dwell times. Further, the duty cycles can include a non-powered dwell time wherein the fluids are allowed to penetrate and work on the spot while all other functions are temporarily suspended. At a convenient time for the user, the user returns to the unattended spot cleaning apparatus 10, unplugs the power cord, removes the recovery tank assembly 18 from the top housing 14, and cleans the recovery tank assembly 18.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention that is described in the appended claims.

What is claimed is:

1. An unattended extraction cleaning machine comprising:

a housing with a bottom portion that is adapted to rest on a surface to be cleaned and that defines an opening in an underside of the housing;

a fluid delivery system mounted to the housing and including a fluid distributor for delivering a cleaning fluid to the surface to be cleaned beneath the opening in the underside the housing;

a fluid extraction system including a suction nozzle for recovering soiled cleaning fluid from the surface to be cleaned beneath the opening in the underside of the housing;

a carriage assembly mounting the suction nozzle to the housing for movement with respect thereto and with respect to the surface to be cleaned; and an ultraviolet light element mounted on the carriage assembly for movement therewith and to emit ultraviolet light onto the surface to be cleaned, wherein the ultraviolet light element is powered by an electrical circuit comprising contact rings;

wherein the electrical circuit further comprises sliding conductive contacts operatively associated with the contact rings and electrically coupled to the ultraviolet light element to conduct electricity from the contact rings to the ultraviolet light element during movement of the carriage assembly.

2. The unattended extraction cleaning machine of claim 1 further comprising a controller which controls the fluid delivery system and the fluid extraction system to perform a cycle of operation and further controls activation of the ultraviolet light element subsequent to a cleaning of the surface to be cleaned.

3. The unattended extraction cleaning machine of claim 2 wherein the controller controls the ultraviolet light such that the ultraviolet light operates for a specified time subsequent to the cleaning of the surface to be cleaned.

4. The unattended extraction cleaning machine of claim 1 wherein the housing further includes a carriage assembly lens that defines the opening in the housing.

5. The unattended extraction cleaning machine of claim 4 wherein the ultraviolet light element is arcuate.

6. The unattended extraction cleaning machine of claim 1 wherein the ultraviolet light element comprises a tubular body, and the ultraviolet light element is mounted to the carriage assembly adjacent the fluid distributor.

7. The unattended extraction cleaning machine according to claim 1 wherein the ultraviolet light element is mounted at a center of the carriage assembly to direct ultraviolet light onto the surface to be cleaned.

8. The unattended extraction cleaning machine according to claim 1 wherein the ultraviolet light element is powered by an electrical circuit comprising at least one inductive coupling.

9. The unattended extraction cleaning machine of claim 1 wherein the electrical circuit has a manually operated switch that controls activation of the ultraviolet light.

10. The unattended extraction cleaning machine of claim 1, further comprising a controller that controls the fluid delivery system, the fluid extraction system, and the ultraviolet light according to a timed duty cycle.

11. The unattended extraction cleaning machine of claim 1, further comprising a controller that controls the fluid delivery system and the fluid extraction system according to a timed duty cycle and further controls operation of the ultraviolet light such that the ultraviolet light operates through the entire duty cycle.

12. The unattended extraction cleaning machine of claim 1 and further comprising a second ultraviolet light element mounted on the housing.

13. The unattended extraction cleaning machine of claim 12 wherein the second ultraviolet light element is mounted in a compartment isolated from the opening.

* * * * *